US011225787B2

(12) United States Patent
Evans et al.

(10) Patent No.: US 11,225,787 B2
(45) Date of Patent: Jan. 18, 2022

(54) DRYWALL SPACING JOIST HANGER

(71) Applicant: Simpson Strong-Tie Company Inc., Pleasanton, CA (US)

(72) Inventors: Thomas G. Evans, Dublin, CA (US); Paul Bernard McEntee, Fremont, CA (US); James M. Benton, Yuba City, CA (US); Emory Lee Montague, Pleasanton, CA (US); Timothy Patrick Murphy, Pleasanton, CA (US)

(73) Assignee: Simpson Strong-Tie Company, Inc., Pleasanton, CA (US)

( * ) Notice: Subject to any disclaimer, the term of this patent is extended or adjusted under 35 U.S.C. 154(b) by 0 days.

(21) Appl. No.: 16/370,582

(22) Filed: Mar. 29, 2019

(65) Prior Publication Data

US 2019/0376275 A1 Dec. 12, 2019

Related U.S. Application Data

(63) Continuation-in-part of application No. 16/001,821, filed on Jun. 6, 2018.

(51) Int. Cl.

| | |
|---|---|
| ***E04B 1/26*** | (2006.01) |
| ***E04C 3/292*** | (2006.01) |
| ***E04C 3/12*** | (2006.01) |
| ***E04B 5/14*** | (2006.01) |

(52) U.S. Cl.

CPC ..... *E04B 1/2612* (2013.01); *E04B 5/14* (2013.01); *E04C 3/125* (2013.01); *E04C 3/292* (2013.01)

(58) Field of Classification Search

CPC .... E04B 1/2608; E04B 1/2612; E04B 1/5818; E04B 2001/2415; E04B 1/185; E05B 5/12; F16B 5/0614

USPC ..... 52/289, 699, 702, 712, 715; 403/232.1

See application file for complete search history.

(56) References Cited

U.S. PATENT DOCUMENTS

| | | | |
|---|---|---|---|
| 537,505 | A | 4/1895 | Van Dorn |
| 1,300,132 | A | 4/1919 | Dessauer |
| 1,692,351 | A | 11/1928 | Ropp |
| 1,728,981 | A | 9/1929 | Ropp |
| 2,461,145 | A | 2/1949 | Carl |
| 2,717,801 | A | 9/1955 | Neil |

(Continued)

FOREIGN PATENT DOCUMENTS

| | | |
|---|---|---|
| EP | 1672133 | 6/2006 |
| ES | 2224819 | 10/2002 |

(Continued)

OTHER PUBLICATIONS

Simpson Strong-Tie, "Wood Construction Connectors: 2013-2014", pages: front cover, 69, 78, 83, 86, 89, 91, 100, 108, 110, 118, 134, 162, back cover, C-2013, Simpson Strong-Tie Company, Inc., Pleasanton, California, USA.

(Continued)

*Primary Examiner* — Brian E Glessner
*Assistant Examiner* — James J Buckle, Jr.
(74) *Attorney, Agent, or Firm* — Charles R. Cypher; James R. Cypher

(57) ABSTRACT

A connection utilizing a joist hanger to hang a joist or beam from a wood structural support member such as a top plate or header in cooperation with a first plurality of fasteners such as screws or nails and one or more substantially vertical fire-resistant panels such as drywall.

7 Claims, 15 Drawing Sheets

(56) References Cited

U.S. PATENT DOCUMENTS 2,815,546 A 12/1957 Kenk
2,911,690 A 11/1959 Carol
3,125,785 A 3/1964 Conville
3,420,560 A 5/1966 Pfahning
3,337,946 A 8/1967 Anderson et al.
3,601,428 A * 8/1971 Gilb ..... E04B 1/2608 248/217.3
3,907,445 A 9/1975 Wendt
3,945,741 A 3/1976 Wendt
3,972,169 A 8/1976 Sheppard, Jr.
3,989,398 A 11/1976 Wendt
4,005,942 A 2/1977 Gilb
4,038,796 A 8/1977 Eckel
4,077,176 A 3/1978 Bauer
4,196,556 A 4/1980 Russo
4,283,892 A 8/1981 Brown
4,330,971 A * 5/1982 Auberger ..... E06B 1/6092 403/232.1
4,353,664 A 10/1982 Gilb
4,411,548 A 10/1983 Tschan
4,422,792 A 12/1983 Glib
4,423,977 A 1/1984 Glib
4,455,805 A 6/1984 Rionda
4,480,941 A * 11/1984 Gilb ..... E04B 1/2612 248/216.1
4,498,801 A 2/1985 Glib
4,527,375 A 7/1985 Braginetz
4,555,887 A 12/1985 Rionda
4,561,230 A 12/1985 Rionda
4,764,069 A 8/1988 Reinwall
4,841,690 A * 6/1989 Commins ..... E04B 1/2608 52/105
4,893,961 A 1/1990 O'Sullivan et al.
4,920,725 A 5/1990 Gore
4,949,929 A 8/1990 Kesselman et al.
4,957,186 A 9/1990 Reetz
4,982,547 A 1/1991 Abbey
5,054,755 A * 10/1991 Hawkes ..... B25B 5/06 269/239
5,058,358 A 10/1991 Stratton
5,071,280 A * 12/1991 Turner ..... E04B 1/2612 403/232.1
5,104,252 A 4/1992 Colonias et al.
5,111,632 A * 5/1992 Turner ..... E04B 1/2612 403/232.1
5,201,156 A 4/1993 Newman
5,228,261 A 7/1993 Watkins
5,240,342 A * 8/1993 Kresa, Jr. ..... E04B 1/2612 248/300
5,394,668 A 3/1995 Lim
5,437,137 A 8/1995 Allen
5,551,135 A 9/1996 Powers, III
5,555,694 A 9/1996 Commins
5,564,248 A * 10/1996 Callies ..... E04B 1/2612 403/232.1
5,598,680 A 2/1997 Wilhelmi
5,603,580 A * 2/1997 Leek ..... E04B 1/2612 403/168
5,625,995 A 5/1997 Martin
5,657,596 A 8/1997 Powers, III
5,692,864 A 12/1997 Powell
5,740,643 A 4/1998 Huntley
5,755,070 A 5/1998 Hohmann
5,778,625 A * 7/1998 Druffel ..... F21S 8/02 174/480
5,829,216 A 11/1998 Newcomb
5,836,131 A 11/1998 Viola et al.
6,079,176 A * 6/2000 Westra ..... E04G 9/10 249/15
6,123,745 A * 9/2000 Hess, III ..... E02D 27/016 249/30
6,131,358 A 10/2000 Wise
6,254,306 B1 7/2001 Williams
6,295,773 B1 10/2001 Alty
6,397,552 B1 6/2002 Bourque
6,427,391 B1 8/2002 Lyons
6,463,711 B1 10/2002 Callies
6,523,321 B1 2/2003 Leek et al.
6,662,511 B1 12/2003 Alty
6,817,157 B2 11/2004 Bourque
6,945,004 B1 9/2005 Ghiringhelli
7,254,926 B2 8/2007 Eldeen
7,334,372 B2 2/2008 Evans et al.
7,343,712 B2 * 3/2008 Shelton ..... E04G 23/0218 52/126.1
7,448,178 B2 * 11/2008 Visone ..... E04B 1/2612 428/582
7,461,494 B2 12/2008 Frezza
7,971,409 B2 * 7/2011 Bak ..... E04B 1/2612 29/897.34
8,051,620 B2 11/2011 Kittlitz et al.
8,250,827 B2 8/2012 Lin et al.
8,322,096 B2 12/2012 Visser
8,387,333 B2 3/2013 Brekke
8,966,857 B2 3/2015 Pope et al.
9,115,489 B2 8/2015 Bourdon
9,206,594 B1 * 12/2015 Grevious ..... F16B 5/0614
9,228,338 B2 1/2016 Lin
9,394,680 B2 7/2016 Bundy et al.
10,024,049 B2 7/2018 Brekke et al.
10,260,232 B1 4/2019 Conboy
10,358,812 B2 7/2019 Jensen et al.
10,653,904 B2 5/2020 Conboy
10,814,150 B2 10/2020 Conboy
10,899,038 B2 1/2021 Conboy
2002/0078656 A1 6/2002 Leek et al.
2004/0244328 A1 * 12/2004 Bak ..... E04B 1/2612 52/712
2005/0155307 A1 7/2005 Timony
2006/0130414 A1 6/2006 Gerda
2006/0191233 A1 * 8/2006 Tamlyn ..... E04B 1/2612 52/702
2007/0294979 A1 * 12/2007 Lin ..... E04B 1/2612 52/702
2008/0101855 A1 * 5/2008 Lin ..... E04B 1/2612 403/232.1
2008/0163568 A1 * 7/2008 Shelton ..... E04G 23/0218 52/126.1
2008/0237421 A1 10/2008 Szpotowski
2009/0113839 A1 * 5/2009 Carr ..... E04B 1/2612 52/712
2012/0137621 A1 6/2012 Buckholdt
2012/0222382 A1 * 9/2012 Brekke ..... E04B 1/2612 52/702
2012/0297724 A1 * 11/2012 Pope ..... E04B 1/2604 52/702
2013/0067850 A1 3/2013 Sasanecki
2015/0167291 A1 * 6/2015 Bundy ..... E04B 1/2612 52/702
2015/0184370 A1 * 7/2015 Brekke ..... E04B 1/2612 52/708
2018/0038094 A1 * 2/2018 Brekke ..... B21D 53/36
2018/0363289 A1 12/2018 Jensen et al.

FOREIGN PATENT DOCUMENTS

FR 2609742 7/1988
GB 185694 9/1922
GB 574457 1/1946
GB 678979 9/1952
GB 726794 3/1955
GB 2452292 3/2009
GB 2472692 2/2011
JP 314482 3/1991
JP 3206225 9/1991
JP 5-19406 3/1993
JP 2515383 10/1996
JP 2537712 6/1997
JP 10088668 4/1998
JP 10-159182 6/1998
JP 11-62253 3/1999
JP 2941921 6/1999

(56) References Cited

FOREIGN PATENT DOCUMENTS

| | | |
|---|---|---|
| JP | 2000-96739 | 4/2000 |
| JP | 3965051 | 8/2007 |
| WO | WO 2011/033289 A1 | 3/2011 |

OTHER PUBLICATIONS

Patent Cooperation Treaty (PCT), The International Search Report and The Written Opinion of the International Searching Authority, or the Declaration: PCT/US2014/070142, dated Apr. 15, 2015, 11 pages, International Searching Authority, European Patent Office, Rijswijk, The Netherlands.

Stormer, Russell D., Office Action in US Reissue U.S. Appl. No. 16/040,467, filed Aug. 15, 2019, 8 pages, US Patent and Trademark Office, Alexandria, Virginia, USA.

*Simpson Strong-Tie Company, inc.* v. *Columbia Insurance Company*, Case No. PGR2019-00063, Exhibit 1035, Minutes of Telephonic Meeting Held on Jan. 30, 2020, filed on Jan. 30, 2020, 29 pages.

*Simpson Strong-Tie Company, inc.* v. *Columbia Insurance Company*, Case No. PGR2019-00063, Exhibit 1036, Supplemental Declaration W. Andrew Fennell in Support of Petitioner's Reply to Patent Owner's Preliminary Response, filed on Feb. 10, 2020, 6 pages.

*Simpson Strong-Tie Company, inc.* v. *Columbia Insurance Company*, Case No. PGR2019-00063, Exhibit 1038, of Dr. Serette Deposition Transcript, in Support of Petitioner's Reply to Patent Owner's Preliminary Response, filed on Jul. 20, 2020, 272 pages.

*Simpson Strong-Tie Company, inc.* v. *Columbia Insurance Company*, Case No. PGR2019-00063, Exhibit 1039, Fennell Declaration, in Support of Petitioner's Reply to Patent Owner's Preliminary Response, filed on Aug. 27, 2020, 28 pages.

*Simpson Strong-Tie Company, inc.* v. *Columbia Insurance Company*, Case No. PGR2019-00063, Exhibit 1040, American Heritage Dictionary, Definition, filed on Aug. 27, 2020, 7 pages.

*Simpson Strong-Tie Company, inc.* v. *Columbia Insurance Company*, Case No. PGR2019-00063, Exhibit 1042, Declaration of W. Andrew Fennell in Support of Petitioner's Reply and Opposition to Patent Owner's Revised Contingent Motion to Amend, filed on Nov. 19, 2020, 31 pages.

*Simpson Strong-Tie Company, inc.* v. *Columbia Insurance Company*, Case No. PGR2019-00063, Exhibit 1043, Blank Rendering of Tsukamoto Reference, filed on Nov. 19, 2020, 1 page.

*Simpson Strong-Tie Company, inc.* v. *Columbia Insurance Company*, Case No. PGR2019-00063, Exhibit 1044, Deposition of Dr. Reynaud Serette, filed on Dec. 22, 2020, 116 pages.

*Simpson Strong-Tie Company, inc.* v. *Columbia Insurance Company*, Case No. PGR2019-00063, Exhibit 1045, Petitioner's Demonstratives for Oral argument, filed on Jan. 14, 2021, 77 pages.

*Simpson Strong-Tie Company, inc.* v. *Columbia Insurance Company*, Case No. PGR2019-00063, Exhibit 2001, Declaration of Dr. Reynaud Serette in Support of Patent Owner's Preliminary Response, filed on Dec. 13, 2019, 124 pages.

*Simpson Strong-Tie Company, inc.* v. *Columbia Insurance Company*, Case No. PGR2019-00063, Exhibit 2002, Curriculum Vitae of Reynaud L. Serette, Ph.D. in Support of Patent Owner's Preliminary Response, filed on Dec. 13, 2019, 15 pages.

*Simpson Strong-Tie Company, inc.* v. *Columbia Insurance Company*, Case No. PGR2019-00063, Exhibit 2015, American Institute of Timper Construction Manual, Fourth Edition, 1994, in Support of Patent Owner's Preliminary Response, filed on Dec. 13, 2019, 17 pages.

*Simpson Strong-Tie Company, inc.* v. *Columbia Insurance Company*, Case No. PGR2019-00063, Exhibit 2016, International Code Council, International Building Code, 2012, in Support of Patent Owner's Preliminary Response, filed on Dec. 13, 2019, 60 pages.

*Simpson Strong-Tie Company, inc.* v. *Columbia Insurance Company*, Case No. PGR2019-00063, Exhibit 2018, MiTek, Fire Wall Hangers FWH Series, Structural Connectors Specification Sheet, 2019, in Support of Patent Owner's Preliminary Response, filed on Dec. 13, 2019, 2 pages.

*Simpson Strong-Tie Company, inc.* v. *Columbia Insurance Company*, Case No. PGR2019-00063, Exhibit 2019, Simpson Strong-Tie, DU/DHU/DHUTF Drywall Hangers Specification Sheet, in Support of Patent Owner's Preliminary Response, filed on Dec. 13, 2019, 4 pages.

*Simpson Strong-Tie Company, inc.* v. *Columbia Insurance Company*, Case No. PGR2019-00063, Exhibit 2021, ICC-ES Evaluation Report, Mar. 2019, in Support of Patent Owner's Preliminary Response, filed on Dec. 13, 2019, 18 pages.

*Simpson Strong-Tie Company, inc.* v. *Columbia Insurance Company*, Case No. PGR2019-00063, Exhibit 2022, Definition From, The New Oxford Dictionary, Second Edition, 2005, in Support of Petitioner's Reply to Patent Owner's Preliminary Response, filed on Dec. 13, 2019, 4 pages.

*Simpson Strong-Tie Company, inc.* v. *Columbia Insurance Company*, Case No. PGR2019-00063, Exhibit 2023, Gypsum Association, Gypsum Panel Products Types, Uses, Sizes, and Standards, 2004, in Support of Patent Owner's Preliminary Response, filed on Dec. 13, 2019, 2 pages.

*Simpson Strong-Tie Company, inc.* v. *Columbia Insurance Company*, Case No. PGR2019-00063, Exhibit 2024, PABCO Gypsum, For Those About to Rock PABCO Gypsum Products, in Support of Patent Owner's Preliminary Response, filed on Dec. 13, 2019, 8 pages.

*Simpson Strong-Tie Company, inc.* v. *Columbia Insurance Company*, Case No. PGR2019-00063, Exhibit 2025, Beall, C., "Fire Ratings of Masonry Walls," 1989, in Support of Patent Owner's Preliminary Response, filed on Dec. 13, 2019, 3 pages.

*Simpson Strong-Tie Company, inc.* v. *Columbia Insurance Company*, Case No. PGR2019-00063, Exhibit 2026, Bilow, D. N., et al., "Fire and Concrete Structures," 2008, in Support of Patent Owner's Preliminary Response, filed on Dec. 13, 2019, 10 pages.

*Simpson Strong-Tie Company, inc.* v. *Columbia Insurance Company*, Case No. PGR2019-00063, Exhibit 2027, Irish Concrete Federation, Comprehensive Fire Protection and Safety with Concrete, Dec. 2007, in Support of Patent Owner's Preliminary Response, filed on Dec. 13, 2019, 33 pages.

*Simpson Strong-Tie Company, inc.* v. *Columbia Insurance Company*, Case No. PGR2019-00063, Exhibit 2028, Montgomery Township Department of Planning and Zoning, Basement Finish/Remodel Code, 2009, in Support of Patent Owner's Preliminary Response, filed on Dec. 13, 2019, 5 pages.

*Simpson Strong-Tie Company, inc.* v. *Columbia Insurance Company*, Case No. PGR2019-00063, Exhibit 2029, Township of Hillsborough, Sample Guide for Finish Basement Requirements in Existing One and Two Family Dwellings, Jan. 30, 2021, in Support of Patent Owner's Preliminary Response, filed on Dec. 13, 2019, 5 pages.

*Simpson Strong-Tie Company, inc.* v. *Columbia Insurance Company*, Case No. PGR2019-00063, Exhibit 2030, Lstiburek, J., "Understanding Basements," Building Science Digest 103, in Support of Patent Owner's Preliminary Response, filed on Dec. 13, 2019, 18 pages.

*Simpson Strong-Tie Company, inc.* v. *Columbia Insurance Company*, Case No. PGR2019-00063, Exhibit 2031, Moisture Control in Buildings: The Key Factor in Mod Prevention, 2nd Edition, 2009, in Support of Patent Owner's Preliminary Response, filed on Dec. 13, 2019, 67 pages.

*Simpson Strong-Tie Company, inc.* v. *Columbia Insurance Company*, Case No. PGR2019-00063, Exhibit 2032, U.S, Department of Agriculture, Forest Service, Wood-Frame House Construction, Agriculture Handbook No. 73, Apr. 1975, in Support of Patent Owner's Preliminary Response, filed on Dec. 13, 2019, 12 pages.

*Simpson Strong-Tie Company, inc.* v. *Columbia Insurance Company*, Case No. PGR2019-00063, Exhibit 2033, CEL Consulting, Inc., Testing of Joist Hangers per AC13 "Acceptance Criteria for Joist Hangers and Similar Devices," in Support of Patent Owner's Preliminary Response, filed on Dec. 13, 2019, 17 pages.

*Simpson Strong-Tie Company, inc.* v. *Columbia Insurance Company*, Case No. PGR2019-00063, Exhibit 2034, Supplemental Dec-

(56) References Cited

OTHER PUBLICATIONS laration of Dr. Reynaud Serette in Support of Patent Owner's Sur-Reply, filed on Feb. 19, 2020, 5 pages.
*Simpson Strong-Tie Company, inc.* v. *Columbia Insurance Company*, Case No. PGR2019-00063, Exhibit 2035, Trimber, K.A., et al., "Measuring Moisture in Walls," Interface, Apr. 2012, in Support of Patent Owner's Sur-Reply, filed on Feb. 19, 2020, 8 pages.
*Simpson Strong-Tie Company, inc.* v. *Columbia Insurance Company*, Case No. PGR2019-00063, Exhibit 2036, U.S. Department of Housing and Urban Development and Research, Building Concrete Masonry Homes: Design and Construction Issues, in Support of Patent Owner's Sur-Reply, filed on Feb. 19, 2020, 43 pages.
*Simpson Strong-Tie Company, inc.* v. *Columbia Insurance Company*, Case No. PGR2019-00063, Exhibit 2037, CGC Inc., The Gypsum Construction Handbook, Centennial Edition, 2005, in Support of Patent Owner's Sur-Reply, filed on Feb. 19, 2020, 34 pages.
*Simpson Strong-Tie Company, inc.* v. *Columbia Insurance Company*, Case No. PGR2019-00063, Exhibit 2038, Clarkwestern Dietrich Building Systems Furring Channel Hat Channel, in Support of Patent Owner's Sur-Reply, filed on Feb. 19, 2020, 3 pages.
*Simpson Strong-Tie Company, inc.* v. *Columbia Insurance Company*, Case No. PGR2019-00063, Exhibit 2039, ASTM International Standard Specification for Testing and Establishing Allowable Loads of Joist Hangers, Designation: D7147-11, in Support of Patent Owner's Sur-Reply, filed on Feb. 19, 2020, 10 pages.
*Simpson Strong-Tie Company, inc.* v. *Columbia Insurance Company*, Case No. PGR2019-00063, Exhibit 2040, APA, Floor Construction Guide, Dec. 2019, in Support of Patent Owner's Sur-Reply, filed on Feb. 19, 2020, 16 pages.
*Simpson Strong-Tie Company, inc.* v. *Columbia Insurance Company*, Case No. PGR2019-00063, Exhibit 2041, International Code Council, 2012 International Building Code, 2011, in Support of Patent Owner's Sur-Reply, filed on Feb. 13, 2020, 17 pages.
*Simpson Strong-Tie Company, inc.* v. *Columbia Insurance Company*, Case No. PGR2019-00063, Exhibit 2042, Supplemental Declaration of Dr. Reynaud Serette in Support of Patent Owner's Sur-Reply, filed on Feb. 26, 2020, 5 pages.
*Simpson Strong-Tie Company, inc.* v. *Columbia Insurance Company*, Case No. PGR2019-00063, Exhibit 2043, Videoconference Deposition of W. Andrew Fennell filed on Jun. 4, 2020, 61 pages.
*Simpson Strong-Tie Company, inc.* v. *Columbia Insurance Company*, Case No. PGR2019-00063, Exhibit 2044, Third Supplemental Declaration of Dr. Reynaud Serette, filed on Jun. 4, 2020, 44 pages.
*Simpson Strong-Tie Company, inc.* v. *Columbia Insurance Company*, Case No. PGR2019-00063, Exhibit 2045, International Code Council, 2012 International Building Code, 2011, filed on Jun. 4, 2020, 6 pages.
*Simpson Strong-Tie Company, inc.* v. *Columbia Insurance Company*, Case No. PGR2019-00063, Exhibit 2046, Buchanan, A. H., Structural Design for Fire Safety, 2001, filed on Jun. 4, 2020, 99 pages.
*Simpson Strong-Tie Company, inc.* v. *Columbia Insurance Company*, Case No. PGR2019-00063, Exhibit 2047, ASTIM International, Standard Test Methods for FireTests of Building Construction and Materials, E119-19, filed on Jun. 4, 2020, 37 pages.
*Simpson Strong-Tie Company, inc.* v. *Columbia Insurance Company*, Case No. PGR2019-00063, Exhibit 2048, American Wood Council, Calculating the Fire Resistance of Exposed Wood members, Technical Report 10, American Forest & Paper Association , filed on Jun. 4, 2020, 55 pages.
*Simpson Strong-Tie Company, inc.* v. *Columbia Insurance Company*, Case No. PGR2019-00063, Exhibit 2049, New Oxford American Dictionary, Second Edition, Definition of "through", filed on Jun. 4, 20202, 4 pages.
*Simpson Strong-Tie Company, inc.* v. *Columbia Insurance Company*, Case No. PGR2019-00063, Exhibit 2050, McEntee, P., "What You Should Know About the New DGH Fire Wall Hanger Options," Feb. 2018, filed on Jun. 4, 2020, 3 pages.
*Simpson Strong-Tie Company, inc.* v. *Columbia Insurance Company*, Case No. PGR2019-00063, Exhibit 2054, Sheet Metal Stamping 101 Parts l-V, filed on Oct. 8, 2020, 39 pages.
*Simpson Strong-Tie Company, inc.* v. *Columbia Insurance Company*, Case No. PGR2019-00063, Exhibit 2055, Declaration of Dr. Reynaud Serette in Support of the Revised Contingent Motion to Amend, filed on Oct. 7, 2020, 12 pages.
*Simpson Strong-Tie Company, inc.* v. *Columbia Insurance Company*, Case No. PGR2019-00063, Exhibit 2056, ANSI/AISC 360-10 Specification for Structural Steel Building, Jun. 22, 2011, filed on Dec. 10, 2020, 35 pages.
*Simpson Strong-Tie Company, inc.* v. *Columbia Insurance Company*, Case No. PGR2019-00063, Exhibit 2057, Declaration of Dr. Reynaud Serette in Support of the Reply to the Opposition to the Revised Contingent Motion to Amend, filed on Dec. 10, 2020, 57 pages.
*Simpson Strong-Tie Company, inc.* v. *Columbia Insurance Company*, Case No. PGR2019-00063, Exhibit 2058, Patent Owner's Notice of Submission of Demonstrative Exhibits for Jan. 14, 2021 Oral Hearing, filed on Jan. 11, 2021, 83 pages.
*Simpson Strong-Tie Company, inc.* v. *Columbia Insurance Company*, Case No. PGR2019-00063, Decision Granting Institution of Post-Grant Review, filed on Mar. 12, 2020, 63 pages.
*Simpson Strong-Tie Company, inc.* v. *Columbia Insurance Company*, Case No. PGR2019-00063, Final Written Decision, filed on Mar. 1, 2021, 143 pages.
*Simpson Strong-Tie Company, inc.* v. *Columbia Insurance Company*, Case No. PGR2019-00063, Patent Owner's Contingent Motion to Amend Under 37 C.F.R. Section 42.221, filed on Jun. 4, 2020, 41 pages.
*Simpson Strong-Tie Company, inc.* v. *Columbia Insurance Company*, Case No. PGR2019-00063, Patent Owner's Corrected Sur-Reply, filed on Mar. 33, 2020, 9 pages.
*Simpson Strong-Tie Company, inc.* v. *Columbia Insurance Company*, Case No. PGR2019-00063, Patent Owner's Preliminary Response to the Petition for Post Grant Review, filed on Dec. 13, 2019, 120 pages.
*Simpson Strong-Tie Company, inc.* v. *Columbia Insurance Company*, Case No. PGR2019-00063, Patent Owner's Reply in Support of Its Revised Motion to Amend, filed on Dec. 10, 2020, 21 pages.
*Simpson Strong-Tie Company, inc.* v. *Columbia Insurance Company*, Case No. PGR2019-00063, Patent Owner's Response to the Petition for Post Grant Review, filed on Jun. 4, 2020, 115 pages.
*Simpson Strong-Tie Company, inc.* v. *Columbia Insurance Company*, Case No. PGR2019-00063, Patent Owner's Sur-Reply, filed on Feb. 20, 2020, 10 pages.
*Simpson Strong-Tie Company, inc.* v. *Columbia Insurance Company*, Case No. PGR2019-00063, Patent Owner's Sur-Reply, filed on Oct. 8, 2020, 37 pages.
*Simpson Strong-Tie Company, inc.* v. *Columbia Insurance Company*, Case No. PGR2019-00063, Petitioner Simpson Strong-Tie, Inc.'s Opposition to Patent Owners Contingent Motion to Amend, filed on Aug. 27, 2020, 30 pages.
*Simpson Strong-Tie Company, inc.* v. *Columbia Insurance Company*, Case No. PGR2019-00063, Petitioner Simpson Strong-Tie, Inc.'s Reply to Patent Owner's Preliminary Response, filed on Feb. 2, 2020, 9 pages.
*Simpson Strong-Tie Company, inc.* v. *Columbia Insurance Company*, Case No. PGR2019-00063, Petitioner Simpson Strong-Tie, Inc.'s Reply to Patent Owner's Response, filed on Aug. 27, 2020, 35 pages.
*Simpson Strong-Tie Company, inc.* v. *Columbia Insurance Company*, Case No. PGR2019-00063, Petitioner's Sur-Reply to Patent Owner's Reply to Petitioner's Opposition to Patent Owner's Revised Contingent Motion to Amend, filed on Dec. 31, 2020, 17 pages.
*Simpson Strong-Tie Company, inc.* v. *Columbia Insurance Company*, Case No. PGR2019-00063, Petitioner Simpson Strong-Tie Company, Inc.'s Opposition to Patent Owner's Revised Contingent Motion to Amend, filed on Nov. 19, 2020, 31 pages.
*Simpson Strong-Tie Company, inc.* v. *Columbia Insurance Company*, Case No. PGR2019-00063, Preliminary Guidance Patent Owner's Motion to Amend, filed on Sep. 21, 2020, 12 pages.

(56) References Cited

OTHER PUBLICATIONS

*Simpson Strong-Tie Company, inc.* v. *Columbia Insurance Company*, Case No. PGR2019-00063, Patent Owner's Revised Motion to Amend, filed on Oct. 8, 2020, 43 pages.
*Simpson Strong-Tie Company, inc.* v. *Columbia Insurance Company*, Case No. PGR2019-00063, Exhibit 2017, International Code Council, International Building Code, 2000, in Support of Patent Owner's Preliminary Response, filed on Dec. 13, 2019, 60 pages.
*Simpson Strong-Tie Company, inc.* v. *Columbia Insurance Company*, Case No. PGR2019-00063, Exhibit 2051, Memorandum of Points and Authorities in Opposition to Motion for Preliminary Injunction, in Support of Patent Owner's Response to the Petition for Post Grant Review, filed on Dec. 13, 2019, 60 pages.
*Simpson Strong-Tie Company, inc.* v. *Columbia Insurance Company*, Case No. PGR2019-00063, Patent Owner's Revised Contingent Motion to Amend, filed on Oct. 8, 2020, 43 pages.
Petition for Post Grant Review of U.S. Pat. No. 10,316,510, dated Sep. 5, 2019, 152 pages.
Petition for Post Grant Review of U.S. Pat. No. 10,316,510, Exhibit 1003, Declaration of W. Andrew Fennell in Support of Petition for Post-Grant Review, dated Sep. 5, 2019, 172 pages.
Petition for Post Grant Review of U.S. Pat. No. 10,316,510, Exhibit 1004, Curriculum Vitae of W. Andrew Fennell, dated Sep. 5, 2019, 6 pages.
Petition for Post Grant Review of U.S. Pat. No. 10,316,510, Exhibit 1016, Fire-Rated Assemblies in Commercial Construction, in Support of Petition for Post-Grant Review, May 2014, 106 pages.
Petition for Post Grant Review of U.S. Pat. No. 10,316,510, Exhibit 1017, Fire Resistance Design Manual Sound Control, in Support of Petition for Post-Grant Review, Jun. 2012, 230 pages.
Petition for Post Grant Review of U.S. Pat. No. 10,316,510, Exhibit 1018, International Building Code, in Support of Petition for Post-Grant Review, May 2011, 12 pages.
Petition for Post Grant Review of U.S. Pat. No. 10,316,510, Exhibit 1030, Stainless steel for durability, fire-resistance and safety, in Support of Petition for Post-Grant, 8 pages.
Petition for Post Grant Review of U.S. Pat. No. 10,316,510, Exhibit 1031, Infringement Claim Chart, in Support of Petition for Post-Grant Review, Aug. 2019, 20 pages.
Installer's Pocket Guide, Simpson Strong-Tie Company, Inc. (2009), pp. 60.
Top-Flange Joist Hangers Installed on Walls Over Wood Structural Panel Sheathing or Drywall, Technical Bulletin, Simpson Strong-Tie Company, Inc. (2013), pp. 2.
S/LBV/S/B and S/BA Hangers, Cold-Formed Steel Connectors for Residential and Mid-Rise Constructions (CC-CFS10, Simpson Strong-Tie Company, Inc. (2010), p. 57, front and back cover, Simpson Strong-Tie Company, Inc.(2010), pp. 3.
Cold-Formed Steel Connectors for Residential and Mid-Rise Construction (C-CFS10), Simpson Strong-Tie Company, Inc. (2010), pp. 76.
Wood Construction Connectors Catalog 2013-2014 (C-2013), Simpson Strong-Tie Company, Inc., pp. 235.
*Columbia Insurance Co. et al.* v. *Simpson Strong-Tie Company, Inc.*, Case No. 3:19-cv-04683, Plaintiffs' Notice of Motion and Motion for Preliminary Injunction; Memorandum of Points and Authorities in Support of Motion, filed in the case on Aug. 12, 2019, 20 pages.
*Columbia Insurance Co. et al.* v. *Simpson Strong-Tie Company, Inc.*, Case No. 3:19-cv-04683, Order Denying Plaintiffs Motion for Preliminary Injunction, filed in the case on Oct. 4, 2019, 20 pages.
*Columbia Insurance Co. et al.* v. *Simpson Strong-Tie Company, Inc.*, Case No. 3:19-cv-04683, Reply in Support of Plaintiffs' Notice of Motion and Motion for Preliminary Injunction, Memorandum of Points and Authorities in Support of Motion, filed in the case on Sep. 13, 2019, 18 pages.
*Columbia Insurance Co. et al.* v. *Simpson Strong-Tie Company, Inc.*, Case No. 3:19-cv-04683, Answer, Affirmative Defenses, and Counterclaim to Complaint for Patent Infringement, filed in the case on Sep. 3, 2019, 8 pages.
*Columbia Insurance Co. et al.* v. *Simpson Strong-Tie Company, Inc.*, Case No. 3:19-cv-04683, Memorandum of Points and Authorities in Opposition to Motion for Preliminary Injunction, filed in the case on Sep. 5, 2019, 31 pages.
*Columbia Insurance Co. et al.* v. *Simpson Strong-Tie Company, Inc.*, Case No. 3:19-cv-04683, Declaration of W. Andrew Fennell in Support of Opposition to Motion for Preliminary Injunction, filed in the case on Sep. 5, 2019, 91 pages.
*Columbia Insurance Co. et al.* v. *Simpson Strong-Tie Company, Inc.*, Case No. 3:19-cv-04683, Declaration of Sam Hensen in Support of Opposition to Motion for Preliminary Injunction, filed in the case on Sep. 5, 2019, 8 pages.
*Columbia Insurance Co. et al.* v. *Simpson Strong-Tie Company, Inc.*, Case No. 3:19-cv-04683, Investigation of U.S. Appl. No. 16/225,517, Exhibit A to Declaration of W. Andrew Fennel in Support of Opposition to Motion for Preliminary Injunction, filed in the case on Sep. 5, 2019, 11 pages.
*Columbia Insurance Co. et al.* v. *Simpson Strong-Tie Company, Inc.*, Case No. 3:19-CV-04683, Declaration of Joseph V. Mauch in Support of Opposition to Motion for Preliminary Injunction, filed in the case on Sep. 5, 2019, 4 pages.
*Columbia Insurance Co. et al.* v. *Simpson Strong-Tie Company, Inc.*, Case No. 3:19-cv-04683, Invalidity Claim Chart, U.S. Pat. No. 10,316,510, Exhibit E to Declaration of Joseph V. Mauch in Support of Opposition to Motion for Preliminary Injunction, filed in the case on Sep. 5, 2019, 30 pages.
*Columbia Insurance Co. et al.* v. *Simpson Strong-Tie Company, Inc.*, Case No. 3:19-cv-04683, Invalidity Claim Chart, U.S. Pat. No. 10,316,510, Exhibit F to Declaration of Joseph V. Mauch in Support of Opposition to Motion for Preliminary Injunction, filed in the case on Sep. 5, 2019, 30 pages.
*Columbia Insurance Co. et al.* v. *Simpson Strong-Tie Company, Inc.*, Case No. 3:19-cv-04683, Invalidity Claim Chart, U.S. Pat. No. 10,316,510, Exhibit G to Declaration of Joseph V. Mauch in Support of Opposition to Motion for Preliminary Injunction, filed on Sep. 5, 2019, 32 pages.
*Columbia Insurance Co. et al.* v. *Simpson Strong-Tie Company, Inc.*, Case No. 3:19-cv-04683, Invalidity Claim Chart, U.S. Pat. No. 10,316,510, Exhibit H to Declaration of Joseph V. Mauch in Support of Opposition to Motion for Preliminary Injunction, filed in the case on Sep. 5, 2019, 32 pages.
*Columbia Insurance Co. et al.* v. *Simpson Strong-Tie Company, Inc.*, Case No. 3:19-cv-04683, Complaint for Patent Infringement, filed in the case on Aug. 12, 2019, 6 pages.

* cited by examiner

DRYWALL SPACING JOIST HANGER

FIELD OF INVENTION

The present invention relates to building construction, and more particularly to a joist hanger adapted to secure a joist to a wall or other structural support member with one or more drywall panels disposed between the end of the joist and the front surface of the structural support member.

BACKGROUND

Joist hangers are used in building construction to secure the ends of joists or other members to walls, headers and/or other support members. Typically, the joist hanger includes a u-shaped portion that receives the joist. The bottom surface of the joist rests on the seat of the hanger, and the side walls of the hanger are dimensioned to closely receive the side faces of the joist, providing it with lateral support.

Where appropriate, the joist may be connected to the hanger by means of nails driven through the side walls into the side faces of the joist. These nails may simply be driven horizontally into the joist, in which case they are preferably short nails that will not pass all the way through the joist. Alternatively, longer nails may be used that are driven horizontally and at an acute angle into the joist such that they are driven into the header as well. This has been referred to as double-shear nailing. The other common way to nail the hanger to the joist is to use short nails that are driven downward at an angle into the joist only.

Often, in order to connect the joist hanger to the header, back flanges are attached to the side walls. Generally, these flanges extend laterally from the side walls, to overlap a portion of the face of the wall. These flanges can extend inwardly or outwardly from the side walls, depending on design considerations.

Openings may be provided in the back flanges to receive fasteners. These fasteners are generally nails in light-frame wood construction. Screws and bolts are also used in wood construction, depending on the size of the members to be joined and other considerations. In light-gauge steel construction, sheet metal screws, bolts and rivets are commonly used.

In perhaps the simplest hangers, the back flanges extend outwardly from the side flanges, providing an easily-accessed fastening face. Fasteners are then driven though the back flanges into the support wall. In other instances, design considerations dictate which particular attachment method is used for attaching the joist and the hanger to the support wall.

In addition, top flanges may be attached to the back flanges to aid in attaching the hanger to the support wall. Hangers with top flanges are generally referred to as top-flange hangers. Hangers without top flanges are generally referred to as face-mount hangers. If the top flanges wrap over the top of the header and down the back of the header, the hanger can be called a wrap-around hanger. Again, various design considerations dictate what features are present in a hanger, and various building considerations dictate which hanger, or type of hanger, is used in a particular situation. Generally, if a top flange is used and the header is made of wood, pre-formed holes are provided in the top flanges to receive suitable fasteners for connecting the top flange to the header. Such fastener openings may not be present in light-gauge steel construction because the hanger is typically fastened to the support wall with self-drilling sheet metal screws or by welding.

As mentioned above, it is often desirable to fasten the joist to the hanger. This is generally done to resist uplift forces acting on the joist. Such forces are often caused by lateral loading on the building due to high winds or seismic activity. Also, one end of a joist must be downwardly restrained if that joist is cantilevered (e.g., to support an overhanging deck). As mentioned above, openings may be provided in the side walls of the hanger so that the joist can be held down with fasteners driven through the openings and into the joist.

Drywall is used in fire barriers, but it can be difficult to shield supporting structural members like top plates and headers at the connection between the supporting wall and a supported joist, because drywall is susceptible to cracking and crushing and has little bearing strength with regard to fasteners received in the drywall. The present invention allows drywall to be easily applied to the supporting structural members, providing some shielding from fire and heat, and provides a joist hanger connection that still allows the drywall to serve as a fire barrier. Importantly, the present invention does not require additional components. The drywall can simply be notched where the projecting side walls of the hanger will pass through the drywall, and then the drywall is inserted between the end of the joist and the wall.

The present invention uses sufficiently strong material for the side walls and the back flanges of the hanger such that they can hold the hanger away from the header and against the one or more drywall panels disposed between the joist and the support member without sagging. The hanger bears the load of the joist without crushing the drywall either during installation or use.

SUMMARY OF THE INVENTION

The present invention provides a connection that allows a joist hanger carrying a joist to be attached to a supporting structural member with fire-resisting, drywall panels interposed between the end of the joist and the supporting structural member such that the drywall panels can help shield the supporting structural member from damage from fire, while providing a strong connection between the joist and the supporting structural member.

The present invention provides a connection in which a joist hanger is fastened to a structural member with drywall panels that have little or no dowel bearing strength being interposed between the end of the joist and the surface of the structural member. The drywall panels cover enough of the end of the joist and enough of the surface of the structural member such that the drywall panels provide some protection to the structural member from the effects of fire.

The present invention provides a connection in which a portion of the joist hanger is held away from the supporting structural member to which it is attached. The present invention provides a joist hanger that has side walls or side members that extend through the one or more drywall panels interposed between the portion of the joist hanger that receives the joist and the supporting structural member. The present invention allows drywall panels to be placed over a supporting structural member thereby providing some shielding from the deleterious effects of fire and heat, with substantial portions of the top edges of the drywall panels reaching at least as high as the top of the structural support member.

The present invention provides a connection in which the joist hanger is provided with a stand-off member for holding the joist away from the support wall.

In one form of the joist hanger, the stand-off is attached to the back plate member or top flange of the joist hanger.

In one form of the joist hanger, the stand-off is attached to one or more of the side walls of the joist hanger.

The present invention provides a connection in which the joist hanger is connected to the supporting structural member by cantilevered side walls that extend through the one or more drywall panels.

The present invention provides a joist hanger that can be fastened to a structural support member with substantially non-load-bearing drywall panels being interposed between the end of the joist and the structural support member.

The present invention provides a hanger with a stand-off member that spans the distance between the end surface of the joist and the support member front face.

The present invention provides a hanger with side walls having back edges, with the upper portions of the back edges of the side walls being offset from the respective lower portions of the back edges of the side walls.

DESCRIPTION OF THE PREFERRED EMBODIMENT

Figure 1:
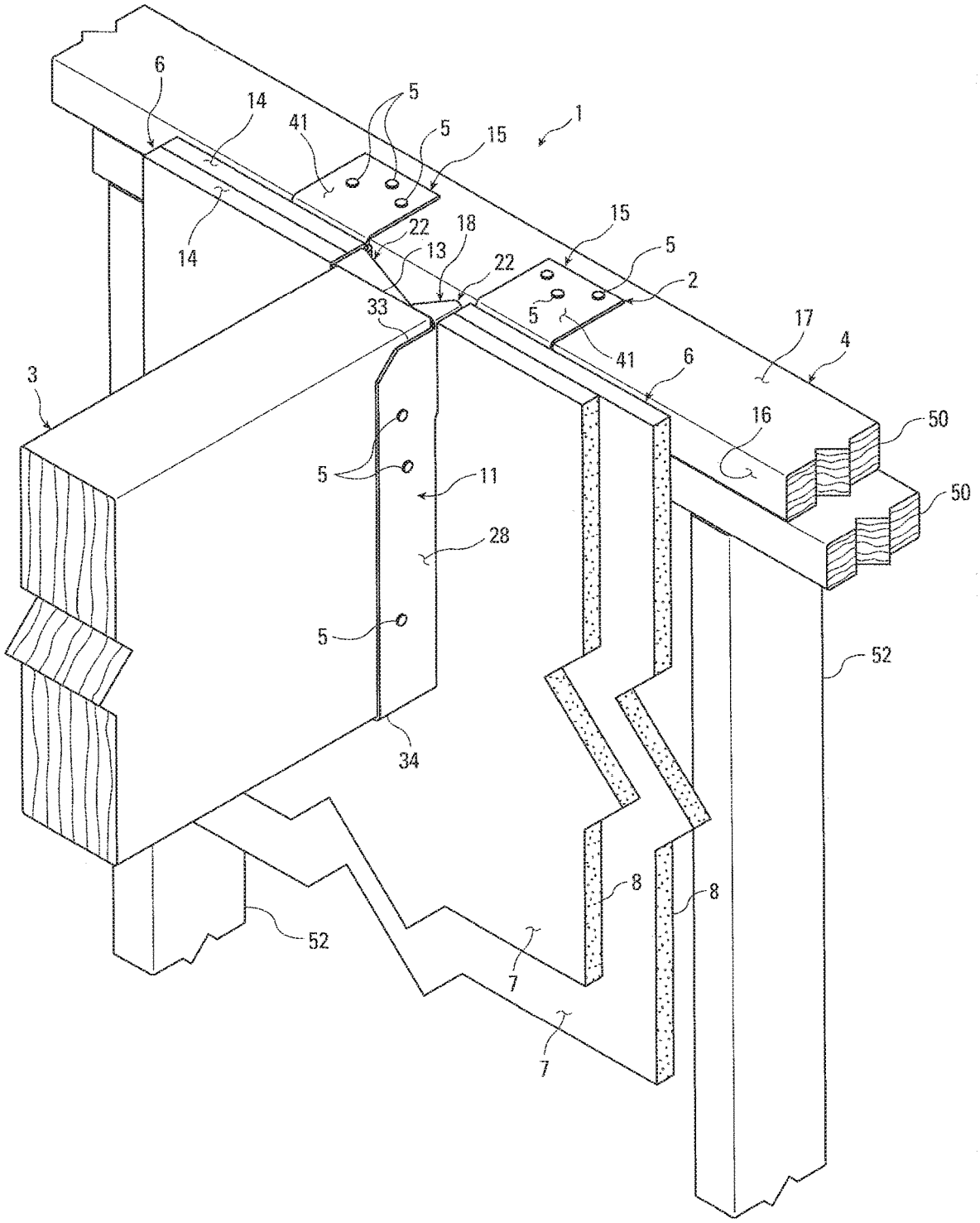
FIG. 1 is an upper right perspective view of a connection formed according to the present invention.

As shown in FIG. 1, the invention is a connection 1 utilizing a joist hanger 2 to hang a joist 3 from a structural support member 4 in cooperation with one or more fasteners 5, and one or more substantially vertical drywall panels 6 are interposed between the joist 3 and the structural support member 4.

Preferably, the one or more drywall panels 6 shield the structural support member 4, and each of the one or more fire-resistant panels 6 has a front face 7, a back face 8 opposite the front face 7, and negligible dowel bearing strength. In order to show the vertically disposed studs and top plate 4 that makes up the wall the panels 6 are not shown as covering these members completely; however, preferably the panels 6 cover all of the structural members that make up the wall to a substantial degree to help protect them from fire.

Preferably, the structural support member 4 has a substantially vertical front face 16 and significant dowel bearing strength. The joist hanger 2 preferably supports the joist 3. The joist 3 has an end face 13 spaced away from the front face 16 of the structural support member 4.

Preferably, the joist hanger 2 has one or more back plate members 9. In FIGS. 1-9, the joist hanger 2 is shown with multiple back plate member 9. In the embodiments shown in FIGS. 10-16, the joist hanger 2 has a single back plate member 9. The joist hanger 2 has a first side wall or side member 11, and a second side wall or side member 11.

The first back plate member 9 preferably has a first back face 10 in parallel registration with the front face 16 of the structural support member 4. Preferably, the second back plate member 9, if present, also has a second back face 10 in parallel registration with the front face 16 of the structural support member 4. The first side member 11 preferably is connected to the first back plate member 9. Preferably, the second side member 11 is connected to the first back plate member 9 or the second back plate member 9, if present.

Figure 2:
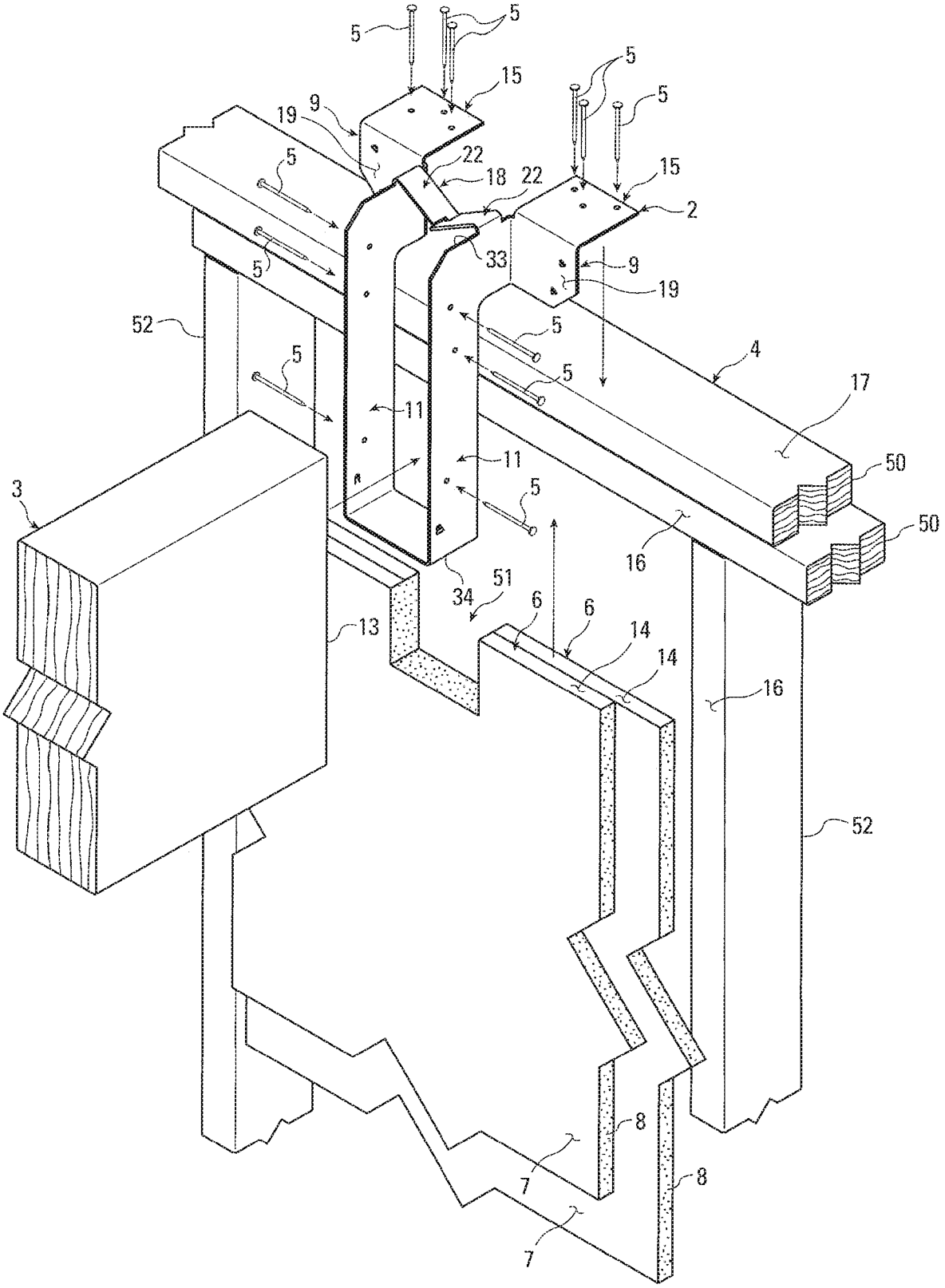
FIG. 2 is an exploded, perspective view of a connection formed according to the present invention.

As shown in FIG. 2, at least one of the first plurality of fasteners 5 preferably passes through the first back plate member 9 and into the structural support member 4. Preferably, at least one of the first plurality of fasteners 5 passes through the second back plate member 9, if present, and into the structural support member 4. The joist 3 preferably is supported by the joist hanger 2. Preferably, the one or more panels 6 are between the joist 3 and the structural support member 4 and the back face 8 of one panel 6 of the one or more panels 6 interfaces with the front face 16 of the structural support member 4.

The one or more back plate members 9 preferably are planar, with front faces 19 opposite the back faces 10. In the embodiment shown in FIGS. 1-9 with first and second back plate members 9, each has first and second inner edges 20 that preferably are linear, and first and second outer edges 21 opposite the first and second inner edges 20. The one or more back plate members 9 preferably have one or more top edges 24 that are oriented upwardly and first and second bottom edges 25 that are oriented downwardly. The one or more back plate members 9 preferably are formed with fastener openings 26. Although the back plate members 9 are shown as splayed outwardly in opposite directions in FIGS. 1-9, they could both be bent inwardly to face each other between the first and second side members 11, or they could both be bent in the same direction, either left or right, with one between the first and second side members 11.

The joist hanger 2 of the present invention is preferably formed from sheet steel.

The first and second side members 11 preferably are planar as well, with first and second inner faces 27 that face the joist 3, and first and second outer faces 28 opposite the first and second inner faces 27.

Figure 4:
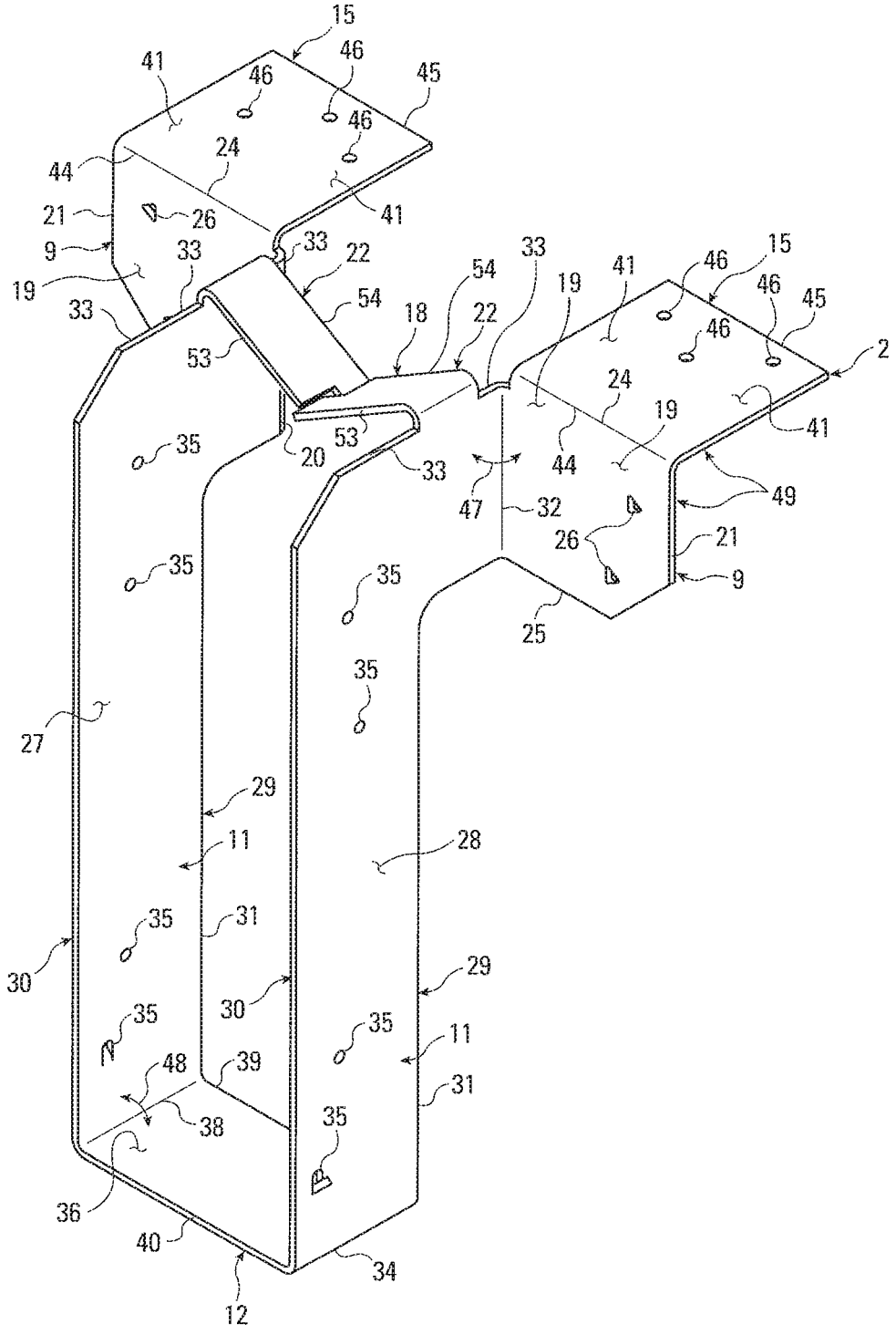
FIG. 4 is an upper right perspective view of the joist hanger shown in FIG. 1.

As shown in FIG. 4, the first and second side members 11 preferably have first and second back edges 29 that form an angular joint 47, preferably an orthogonal joint, where they meet the first and second inner edges 20 of the first and second back plate members 9. As shown in FIG. 4, the first and second back edges 29 of the first and second side members 11 form an angular joint 47 with the back plate members 9.

The first and second side members 11 preferably have first and second front edges 30 opposite the first and second back edges 29.

Figure 3:
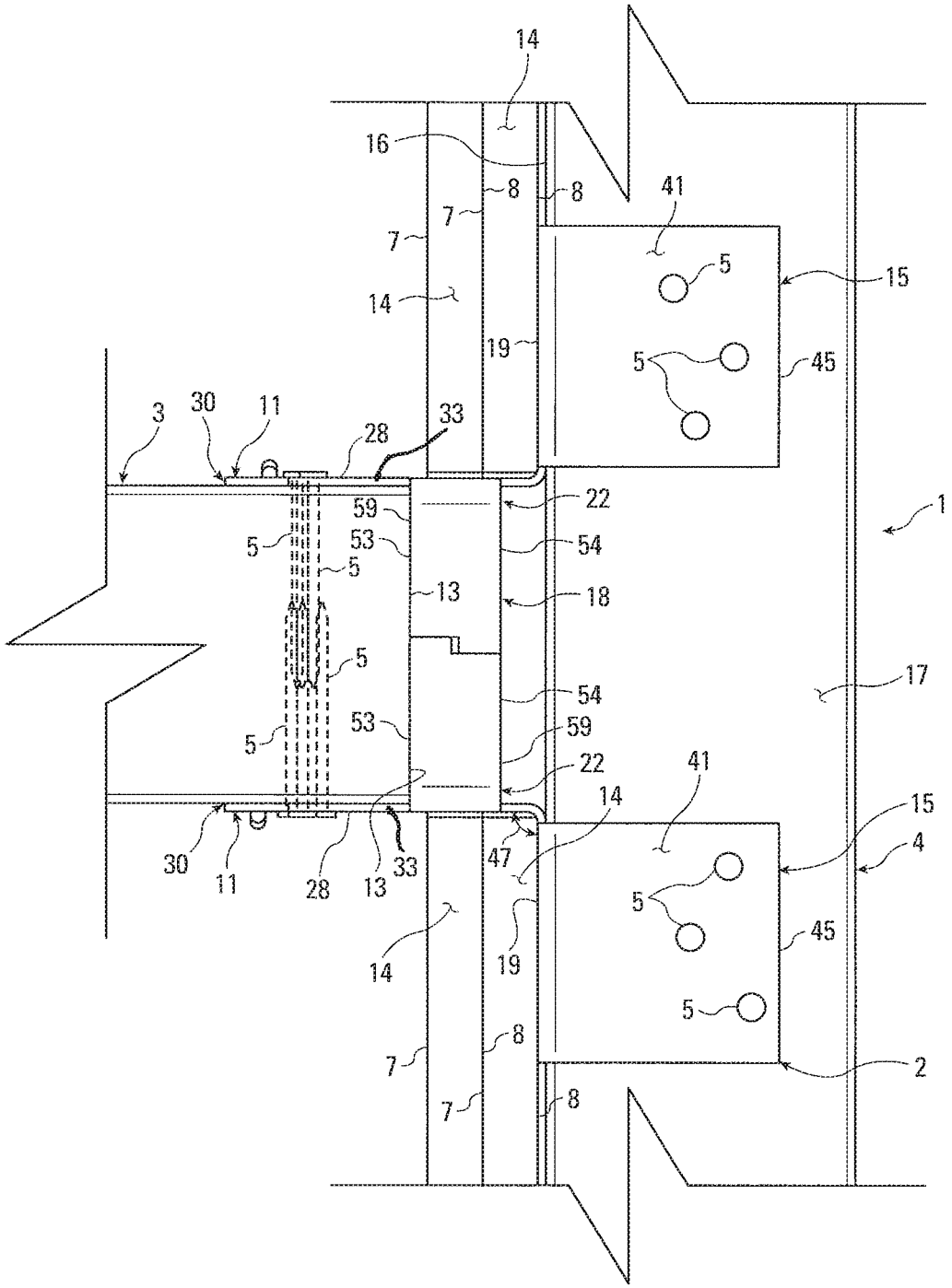
FIG. 3 is a top plan view of the connection shown in FIG. 1.
Figure 11:
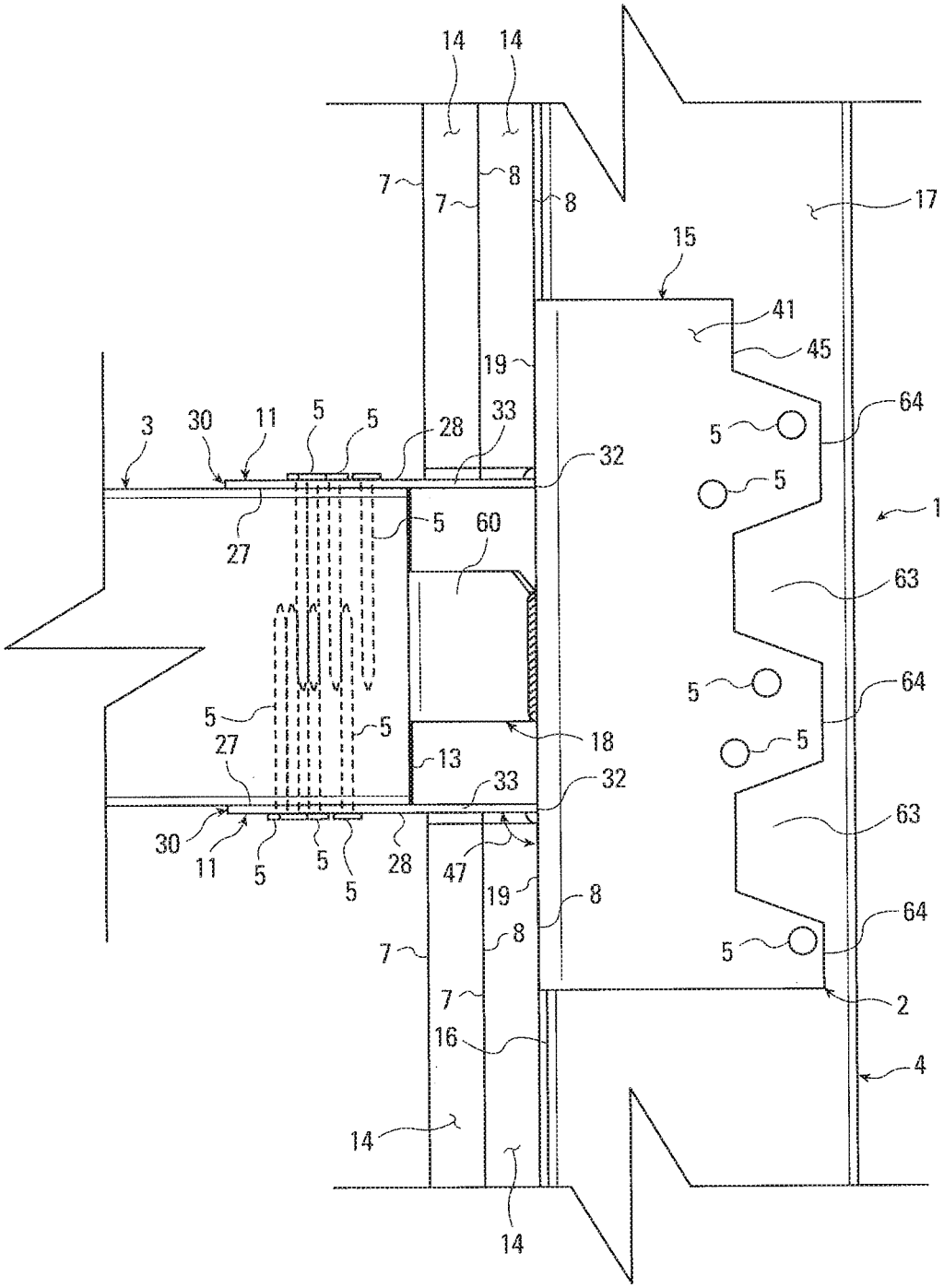
FIG. 11 is a top plan view of the connection shown in FIG. 10.
Figure 12:
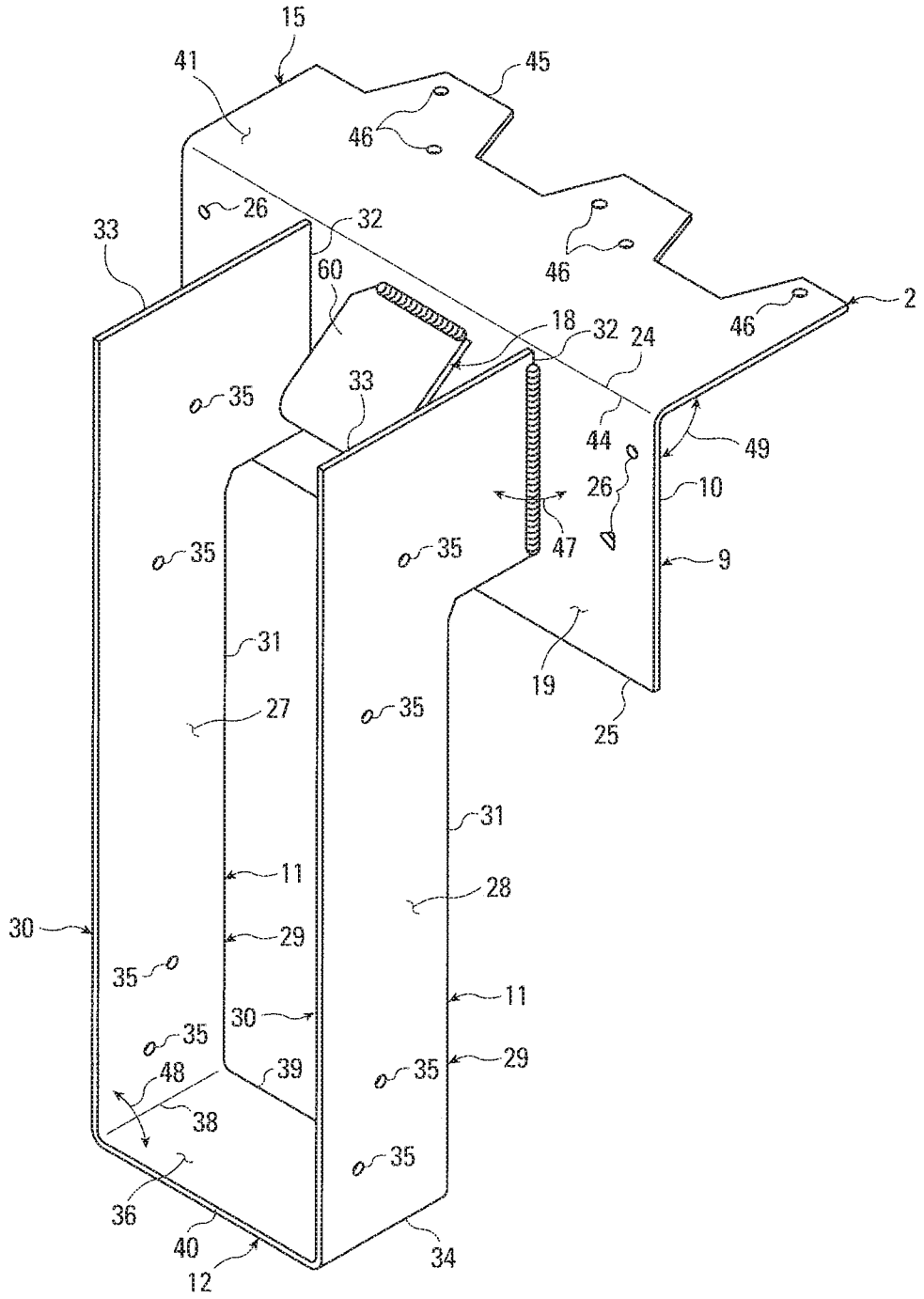
FIG. 12 is an upper right perspective view of the joist hanger shown in FIG. 10.
Figure 13:
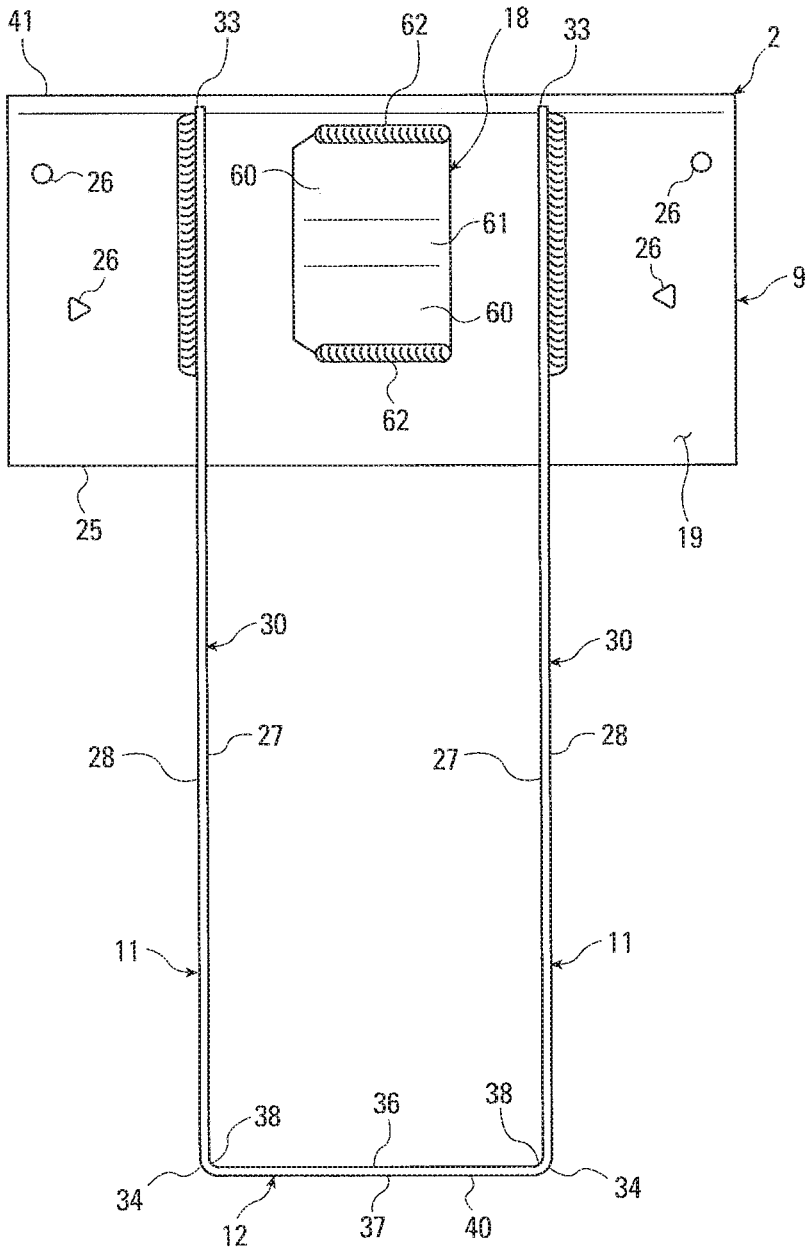
FIG. 13 is a front elevation view of the joist hanger shown in FIG. 10.
Figure 14:
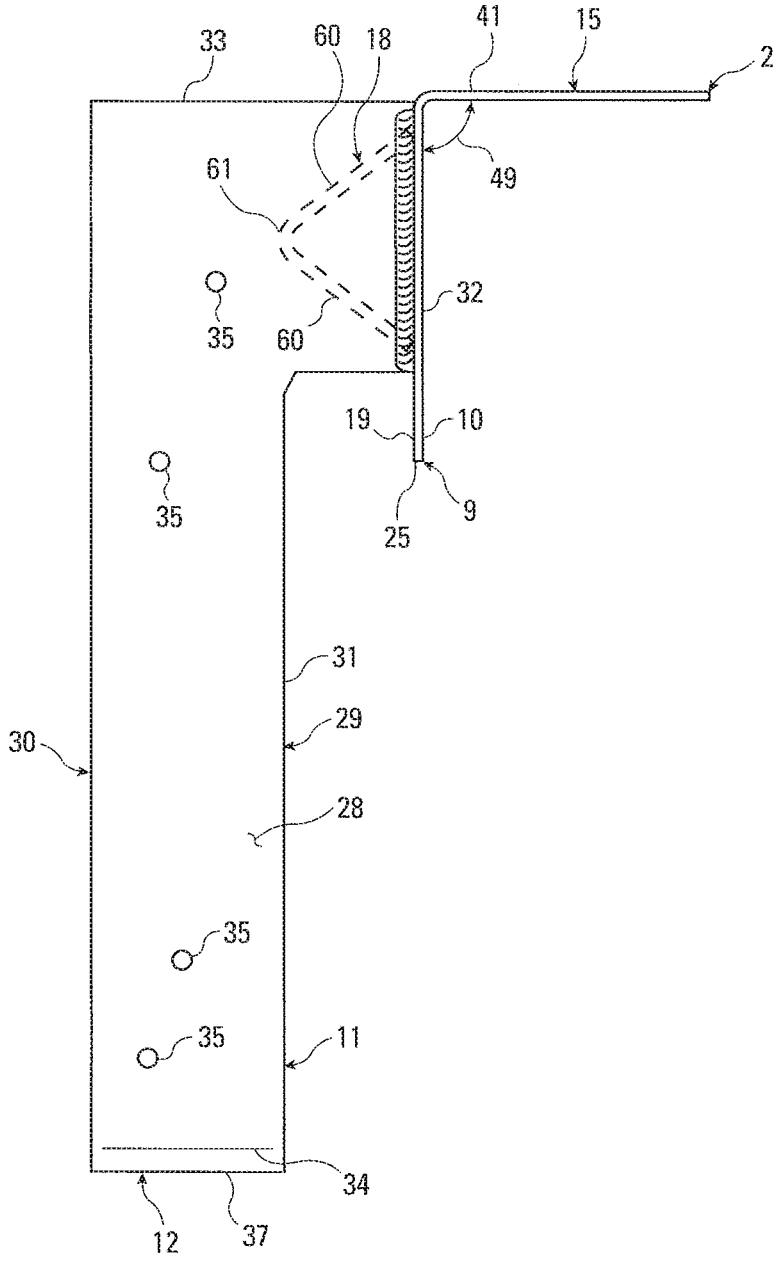
FIG. 14 is a left side elevation view of the joist hanger shown in FIG. 10.
Figure 15:
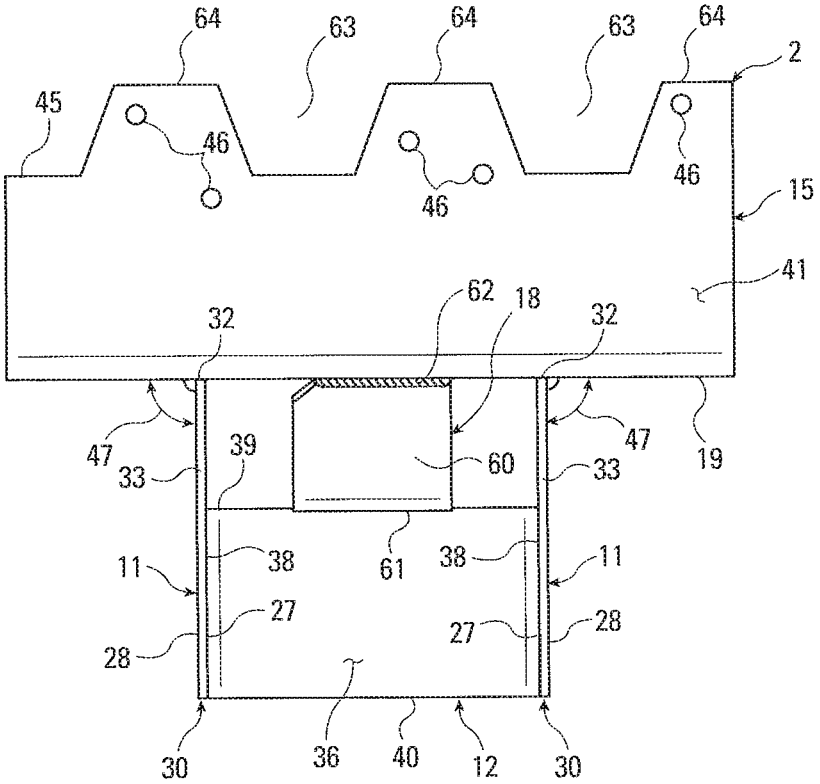
FIG. 15 is a top plan view of the joist hanger shown in FIG. 10.
Figure 16:
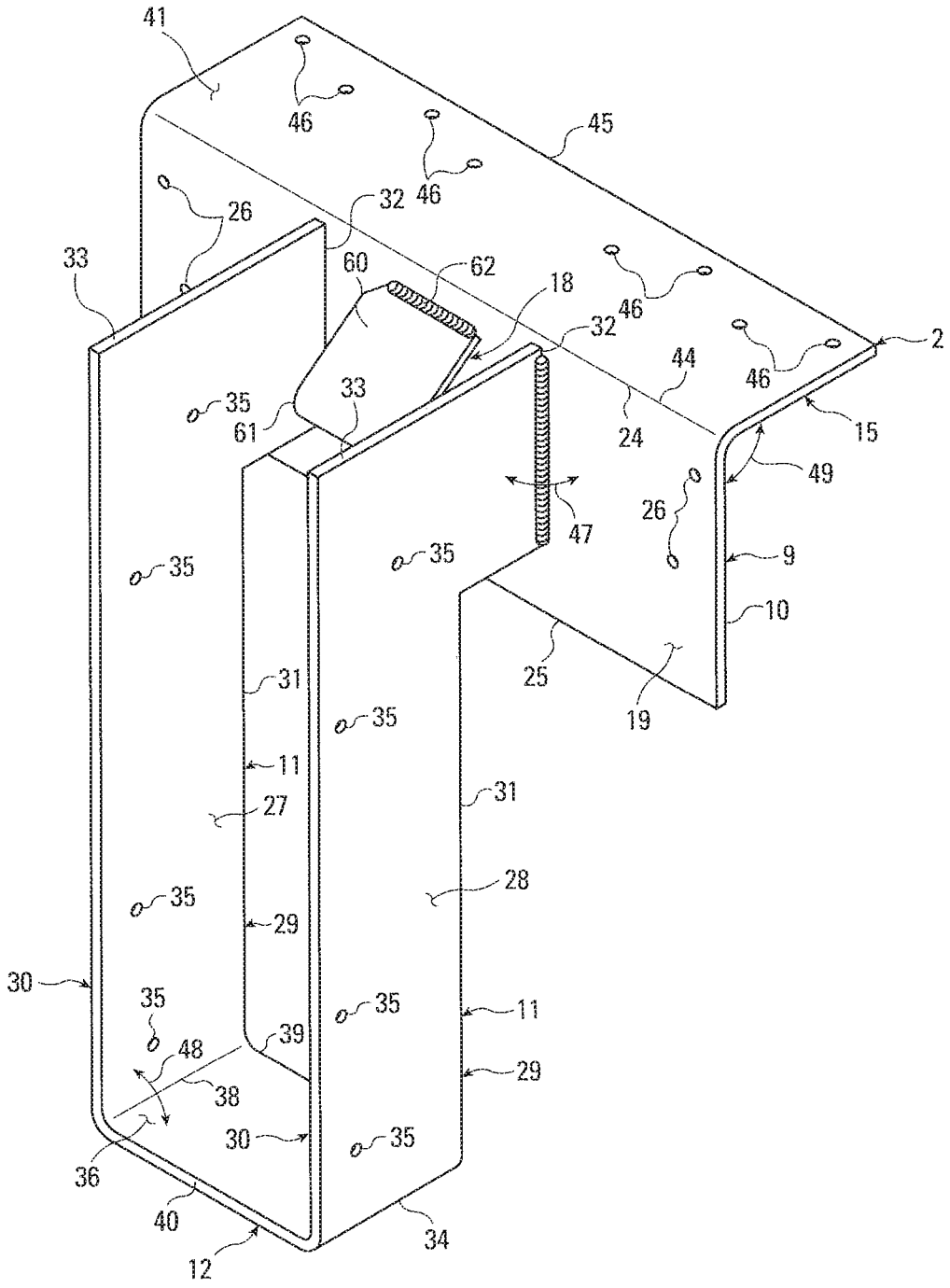
FIG. 16 is an upper right perspective view of an alternate joist hanger.

The first and second back edges 29 preferably have lower portions 31 and upper portions 32 with the first and second lower portions 31 being offset from the first and second upper portions 32. This creates space between the lower portion of the first and second side members 11 where the drywall panels 6 can be inserted behind the end of the joist 3 without having to notch or disturb these portions of the drywall panels 6. The side members 11 are generally L-shaped members with the upper portions extending through the drywall panels 6. As shown in FIG. 12 the upper portions 32 of the first and second back edges 29 are welded to the back plate 9. As shown in FIGS. 3 and 11, a stand-off member 18 can be attached to the hanger 2. The stand-off members hold the end or end surface 13 of the joist away from the front surface 7 of the drywall panel 6 closest to the end 13 of the joist 3. The lower portions 31 of the second back edges 29 are disposed in front of the front face or surface 7 of the outermost drywall panel 6 which is the front surface 7 of the drywall panel 6 closest to the end 13 of the joist 3.

The first and second side members 11 preferably have first and second top edges 33. As shown in FIG. 4, side top flanges 22 can be connected to the top edges 33 to strengthen the side members 11. As shown in FIG. 4, the side top flanges 22 can serve as the stand-off member 18. The first and second side members 11 also preferably have first and second bottom edges 34 opposite the first and second top edges 33. The first and second side members 11 preferably are formed with fastener openings 35.

The one or more panels 6 preferably are drywall panels 6. Drywall, otherwise known as plasterboard, wallboard, gypsum board, sheetrock, or gyprock, is typically a panel made of gypsum plaster pressed between two thick sheets of paper. It is used as part of interior walls and ceilings. In the United States and Canada, drywall panels are manufactured in 48-inch wide panels in varying lengths. Common panel thicknesses are ½-inch and ⅝-inch. In the present invention, two layers of ⅝-inch drywall is preferred. Drywall is naturally fire resistant and can be used to cover and protect the structural members of a building. However, gypsum is friable and has little or no dowel bearing strength. Other panel materials and qualities are also possible.

Preferably, the joist hanger has a seat member 12 interconnecting the first and second side members 11, and the joist 3 rests on the seat member 12 between the first and second side members 11.

Preferably, the back surface 8 of the rearmost drywall panel 6 and the upper portions 32 of the back edges 29 of the side members 11 contact or are in close proximity to the front face 16 of the structural support member 4. The side members 11 extend through the drywall panels 6. Preferably, the joist hanger 2 is not embedded in the structural support member 4, although it is attached to the structural support 4 member with fasteners 5, and while not shown the wall can have members above what is shown in the Figs., including additional panels 6. The seat member 12 preferably has an upper face 36 that interfaces with the joist 3. The seat member 11 also preferably has a lower face 37 opposite the upper face 36, first and second linear side edges 38, a back edge 39 that can be orthogonal to the first and second side edges 38, and a front edge 40 that can be parallel to the back edge 39. The first and second side edges 38 preferably form an angular joint 48, where they meet the first and second bottom edges 34 of the first and second side members 11.

The joist hanger 2 has one or more top flanges 15 connected to the one or more back plate members 9. The one or more top flanges 15 preferably contact the top face 17 of the structural support member 4. Although, the top face 7 of the structural support member does not need to be the top of the wall, and additional panels 6 could be disposed above the panels shown 6. Preferably, the one or more top flanges 15 are fastened to the structural support member 4. The structural support member 4 preferably has a top face 17, the first and second top flanges 15 are fastened to the top face 17 of the structural support member 4. Preferably, the first and second top flanges 15 are fastened to the structural support member 5 with one or more fasteners 5. As shown these fasteners 5 can be nails.

The one or more top flanges 15 preferably are planar, with upper faces 41 and bottom faces 42 opposite the upper faces 41. Preferably, the bottom faces 42 contact the top face 17 of the structural support member 4. The one or more top flanges 15 preferably have front edges 44 and back edges 45. The back edges 45 can be formed with a series of spaced notches 63 with tabs 64 between the notches 63. The front edges 44 preferably form an angular joint 49, preferably orthogonally where they meet the one or more top edges 24 of the one or more back plate members 9. The first and second top flanges 15 can be formed with fastener openings 46. The tabs 64 can have fastener openings 46 for placing the fasteners 5 farther from the support member from face 16 while the notches 63 between the tabs 64 conserve material of the one or more top flange 15.

Typically, the structural support member 4 is a top plate 4 which can consist of one or more parts 50. The parts 50 of the top plate 4 can be two pieces of nominal 2"×4" or 2"×6" dimensional lumber 50. The structural support member 4 can include the studs 52 that support the structural support member 4 and make up the wall. Only a few studs 52 are shown in the drawings, but typically studs 52 will be spaced uniformly along and underneath the top plate with more studs 52 being used where more bearing strength is needed.

Preferably, each of the one or more panels 6 has a top edge face 14 and the structural support member 4 has a top face 17. In the preferred embodiment, only a small notch 51 is made in the one or more drywall panels 6 between the end 13 of the joist 3 and the structural support member 4 such that most of the top edge face 14 of each of the one or more panels 6 preferably is located at the level of the top face 17 of the structural support member or above the top face 17 of the structural support member 4, thereby helping to shield and protect the structural support member 4. Similarly, the drywall panels 6 are disposed between most of the end 13 of the joist 3 and the wall of which the structural support member 4 is a part.

Figure 7:
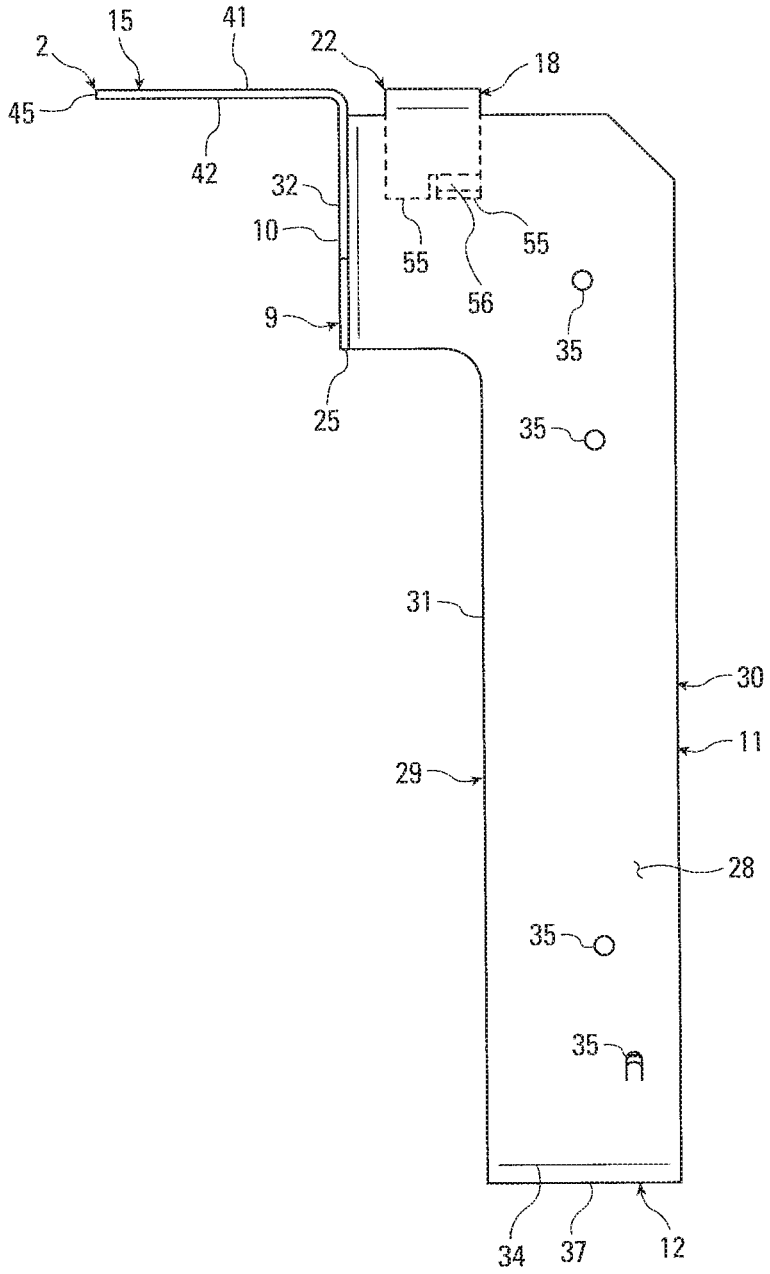
FIG. 7 is a right side elevation view of the joist hanger shown in FIG. 1.
Figure 8:
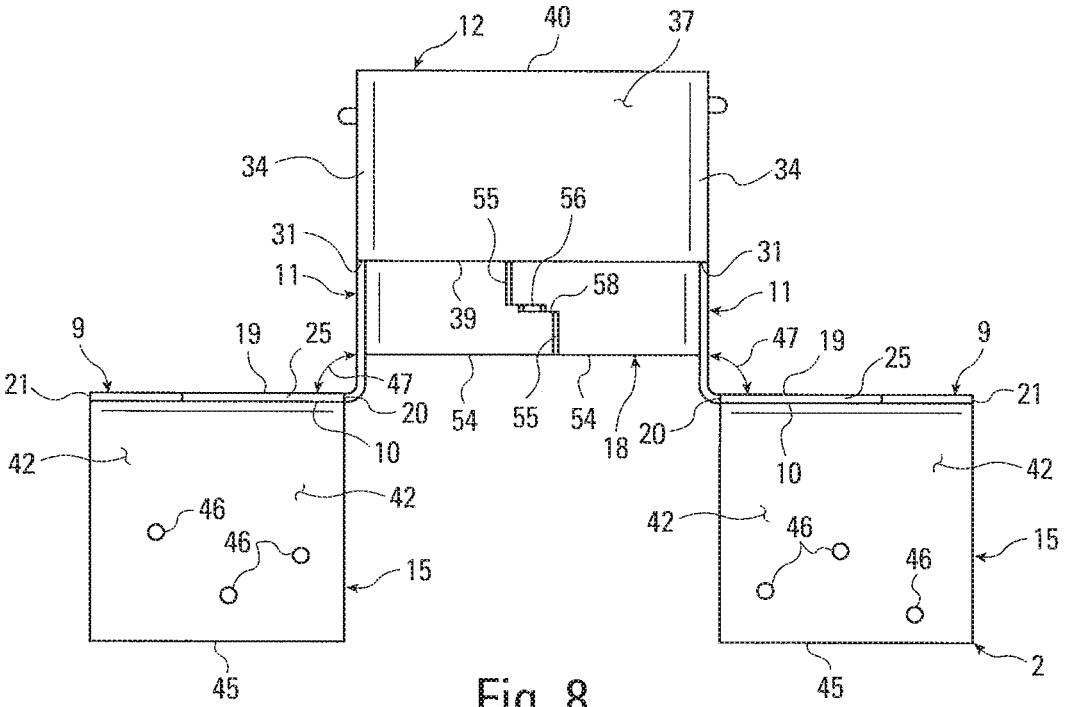
FIG. 8 is a bottom plan view of the joist hanger shown in FIG. 1.
Figure 9:
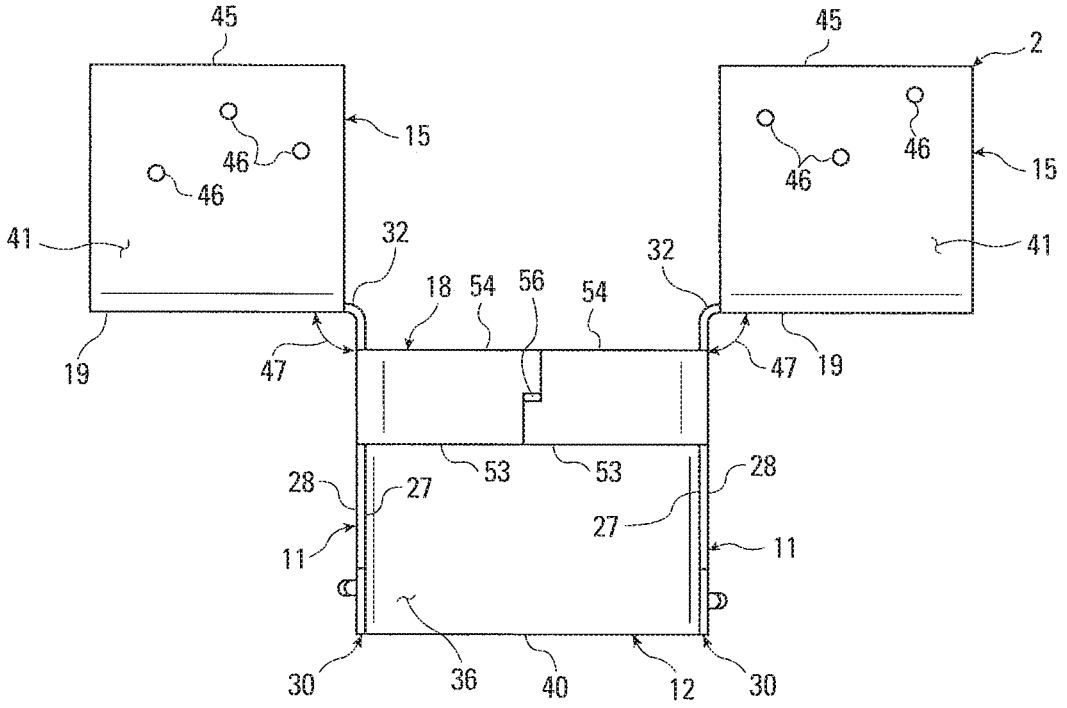
FIG. 9 is a top plan view of the joist hanger shown in FIG. 1.
Figure 10:
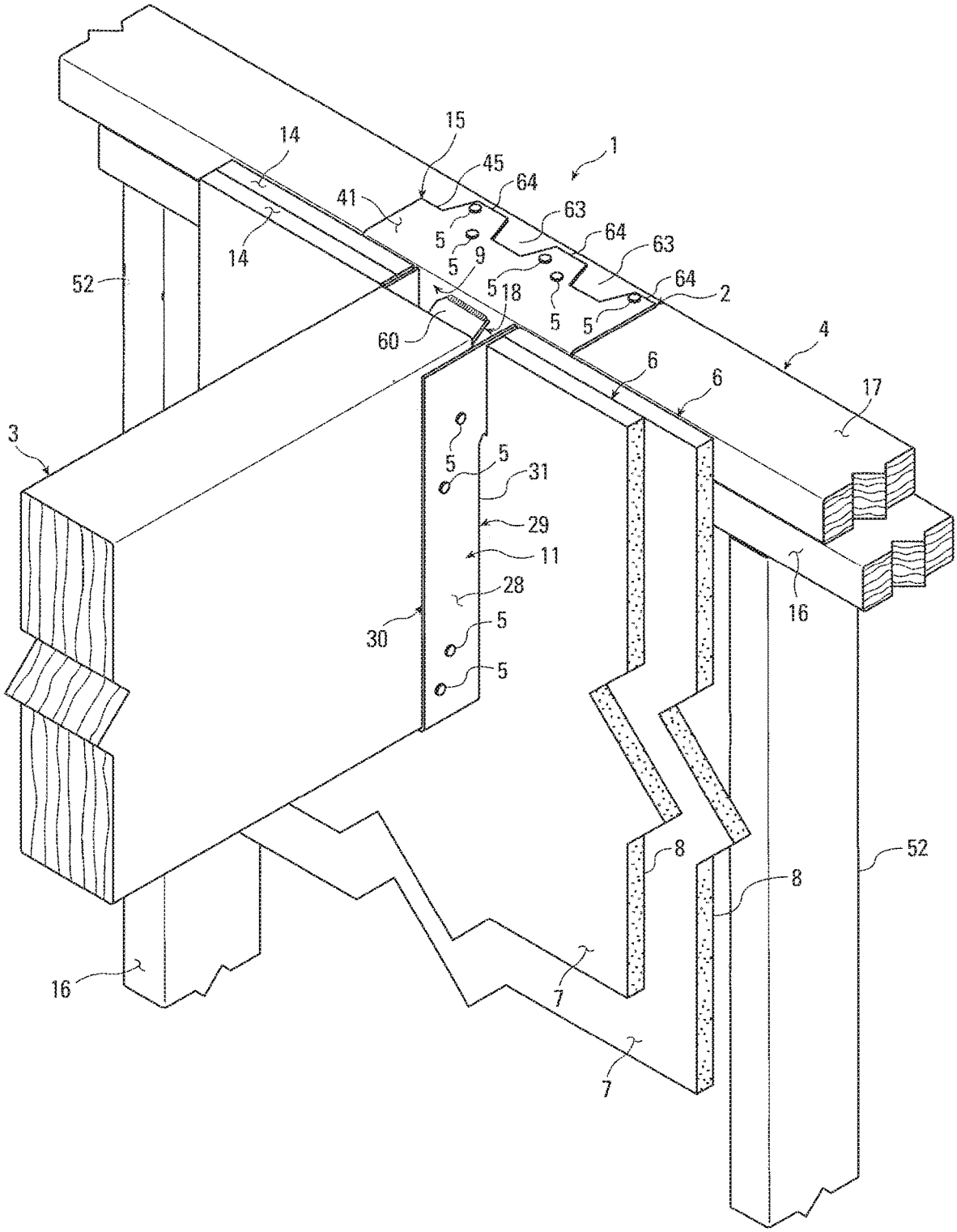
FIG. 10 is an upper right perspective view of an alternate joist hanger making the connection shown of the present invention.

As shown in FIGS. 4 and 7, the first back plate member 9 preferably has a first top edge 24, a first bottom edge 25, a first substantially vertical inner edge 20, a first outer edge 21 opposed to the first substantially vertical inner edge 20, and a first back face 10 adapted to be in parallel registration with the front face 16 of the structural support 4. Preferably, the second back plate member 9 also has a second top edge 24, a second bottom edge 25, a second substantially vertical inner edge 20, a second outer edge 21 opposed to the second substantially vertical inner edge 20, and a second back face 10 in parallel registration with the front face 16 of the structural support member 4.

Substantially all of the one or more back faces 10 of the one or more back plate members 9 preferably interfaces with the front face 16 of the structural support 4. The joist hangers 2 of FIGS. 10-16 are preferably formed by forming the back plate member 9 and the top flange 15 as a single piece and the seat member 12 and side members 11 as a single piece and joining the two parts together by welding. The joist hanger 2 of FIGS. 1-9 is preferably formed as a single piece of sheet metal that is bent into its final shape.

Figure 5:
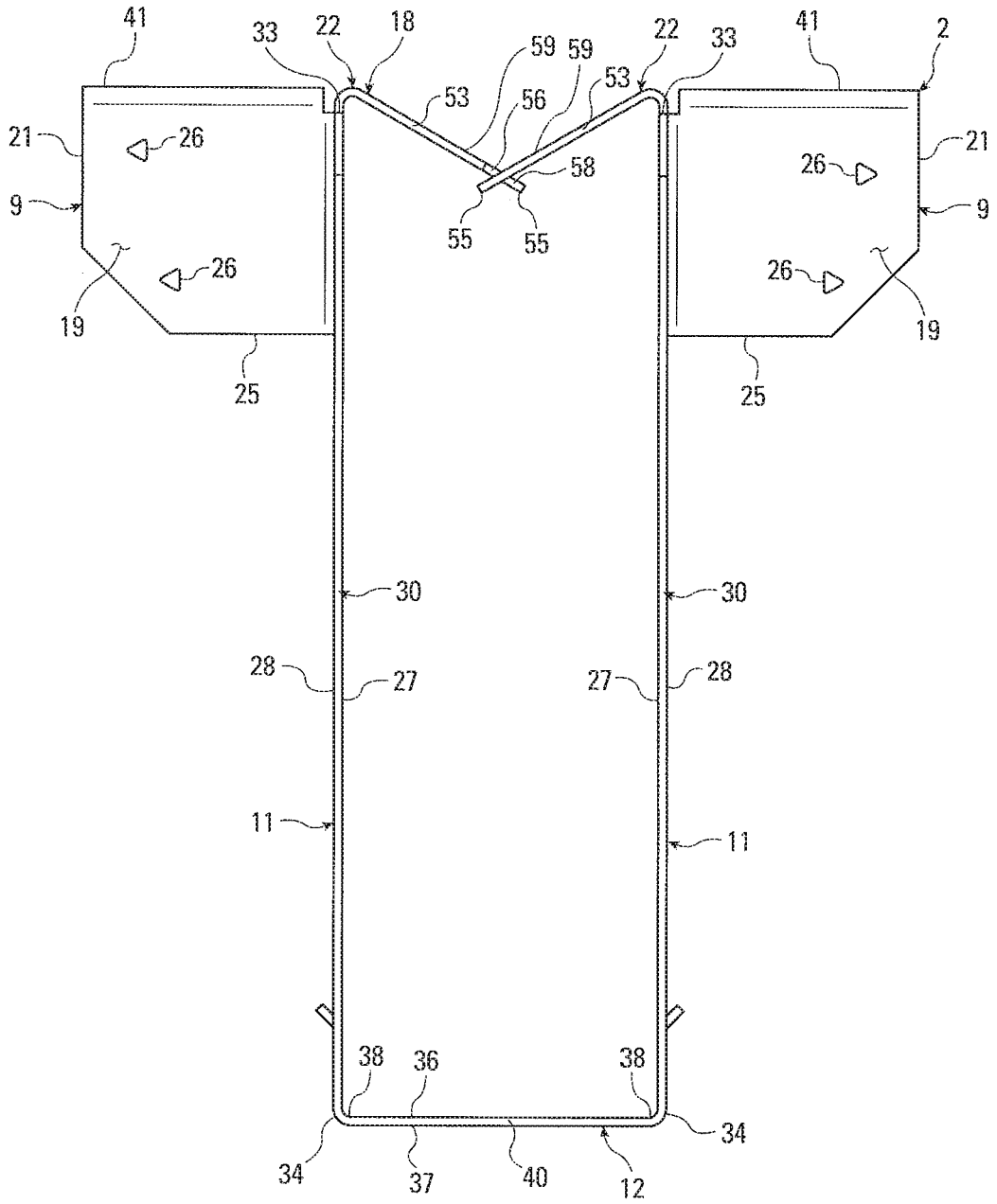
FIG. 5 is a front elevation view of the joist hanger shown in FIG. 1.
Figure 6:
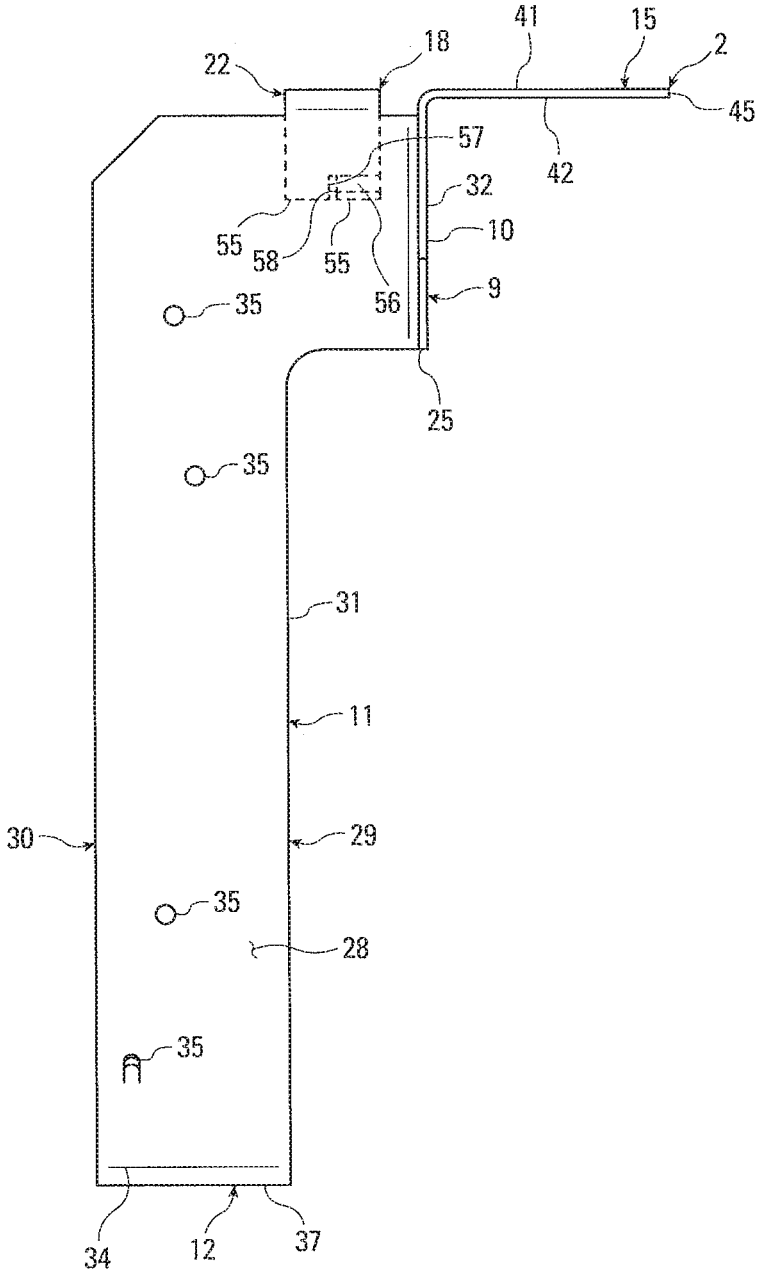
FIG. 6 is a left side elevation view of the joist hanger shown in FIG. 1.

As shown in FIGS. 3, 4 and 5, the stand-off member 18 can be formed as one or more side top flanges 22 bent from the side members 11. As shown, a side top flange 22 is bent from each side member 11 to form a pair of side top flanges 22. The side top flanges 22 are generally planar members except where they are bent from the side members 11, but the side top flanges 22 need not be generally planar. As shown in the FIG. 5, the side top flanges 22 overlap. The side top flanges 22 each have a front edge 53 and a back edge 54. As is also shown, preferably each side top flange 22 at a distal end 55 from the side member 11 is formed with a step 56 where the side top flanges 22 narrow. The steps 56 form median edge members 57 and 58 in the side top flanges with the median edge members 57 and 58 facing each other. The median edge member 57 on the side top flange 22 with the distal end 55 closer to the end face 13 of the joist 3 faces the structural support member 4, and the median 58 on the side top flange 22 with the distal end 55 closer to the structural support member 4 faces the end face 13 of the joist. As shown in FIGS. 3, 4 and 5 the step is preferably formed in the front edge 53 of one of the side top flanges 22 and the step is formed in the back edge 54 of the other of the side top flanges 22. The side top flanges 22 are bent from the side members 11 at the proximal ends 59 of the side top flanges. With the steps 56 in the side top flanges 22, a portion of the distal ends 55 of each side top flange 22 can be disposed below a portion of the proximal end 59 of the other of the side top flange 22. The stepped, overlapping of the side top flanges 22 can help the plurality of side top flanges 22 to work together to resist movement of the joist 3 towards the structural support member 4.

As shown in FIGS. 4 and 5, preferably the side top flanges 22 are bent at an acute angle to the respective side members 11 from which they depend.

As shown in FIGS. 11, 12, 13 and 14, a stand-off member 18 can be provided on the one or more back plates 9 of the hanger 2. As shown, the stand-off member 18 is a bent member attached to the back plate 9 of the hanger 2. The stand-off member 18 is a generally v-shaped member with two generally flat, planar members 60 meet at a large-radius bend 61. As shown in FIGS. 11, 12, 13 and 14, one or more welds 62 connect the stand off member 18 to the back plate 9.

We claim:

1. A connection (1) utilizing a joist hanger (2) to hang a joist (3) from a structural support member (4) in cooperation with a first plurality of fasteners (5) and one or more vertical drywall panels (6), the connection (1) comprising:

a. the one or more drywall panels (6) providing shielding to the structural support member (4), each having a front face (7), a back face (8) opposite the front face (7), the panels (6) being drywall panels such that they have negligible dowel bearing strength compared to the structural support member (4);

b. one or more of the first plurality of fasteners (5) connecting the joist hanger (2) to the structural support member (4);

c. the structural support member (4) having a vertical front face (16) and the structural support member (4) having significant dowel bearing strength compared to the one or more drywall panels (6);

d. the joist (3) supported by the joist hanger (2), the joist having an end face (13) spaced away from the vertical front face (16) of the structural support member (4); and e. the joist hanger (2) supporting the joist (3), the joist hanger (2) comprising:

i. one or more back plate members (9) having one or more back faces (10) in parallel registration with the front face (6) of the wood structural support member (4);

ii. a first side member (11) connected to the one or more back plate members (9); and iii. a second side member (11) connected to the one or more back plate members (9), the first and second side members (11) having first and second back edges (29) with the first and second back edges (29) having first and second lower portions (31) and first and second upper portions (32), the first and second upper portions contacting and registering with the one or more back plate members (9) with the first and second upper portions (32) being spaced from each other where the first and second upper portions (32) contact and register with the one or more back plate members (9);

iv. one or more stand-off members (18) are connected to the joist hanger (2) that interface with the end face (13) of the joist (3) and space the end face (13) of the joist away from the vertical front face (16) of the structural support member (4); wherein:

f. portions of the one or more panels (6) are disposed between the end face (13) of the joist (3) and the structural support member (4) and the back face (8) of one panel (6) of the one or more panels (6) interfaces with the front face (16) of the structural support member (4).

2. The connection (1) of claim 1 wherein:

the joist hanger (2) has a seat member (12) interconnecting the first and second side members (11); wherein the joist (3) rests on the seat member (12) between the first and second side members (11).

3. The connection (1) of claim 1 wherein:

a. the joist hanger (2) has one or more top flanges (15) connected to the one or more back plate members (9);

b. the structural support member (4) has a top face (17); and the one or more top flanges (15) are fastened to the top face (17) of the structural support member (4).

4. The connection (1) of claim 1 wherein:

a. each of the one or more panels (6) has a top edge face (14);

b. the structural support member (4) has a top face (17); and c. portions of the top edge face (14) of each of the one or more panels (6) is located at the level of the top face (17) of the structural support member or above the top face (17) of the structural support member.

5. The connection (1) of claim 1 wherein:

the first and second side members (1) have first and second top edges (33), and side top flanges (22) are connected to the top edges (33).

6. The connection (1) of claim 1 wherein:

the first and second lower portions (31) being offset from the first and second upper portions (32), with the upper portions 32 contacting the one or more back plate members (9), and the lower portions being spaced away from the front face (16) of the structural support member (4).

7. The connection (1) of claim 1 wherein:

the one or more stand-off members (18) are attached only to the one or more back plate members (9) and are not connected to the first and second side members (11).

* * * * *